US005442128A

United States Patent [19]

Bodini et al.

[11] Patent Number: 5,442,128

[45] Date of Patent: Aug. 15, 1995

[54] DIGITAL CLASSIC ORGAN WITH REMOTE CONTROL FINISHING

[75] Inventors: Giacomo F. Bodini, Saludecio; Primo Cimaroli, Coriano, both of Italy

[73] Assignee: Generalmusic S.P.A., Mondaino, Italy

[21] Appl. No.: 907,776

[22] Filed: Jun. 30, 1992

[30] Foreign Application Priority Data

Mar. 31, 1992 [IT] Italy ..... BO92A0116

[51] Int. Cl.[6] ..... G10H 7/00; G10H 1/24

[52] U.S. Cl. ..... 84/620; 84/632; 84/DIG. 5; 84/DIG. 27; 84/456

[58] Field of Search ..... 84/84, 620, 630, 632, 84/686, 710, DIG. 5, DIG. 26, DIG. 27, 454, 456

[56] References Cited

U.S. PATENT DOCUMENTS

| | | | |
|---|---|---|---|
| 3,083,608 | 2/1963 | McKitrick . | |
| 3,733,593 | 5/1973 | Molnar | 84/620 X |
| 3,981,218 | 9/1976 | Luce | 84/686 X |
| 4,099,437 | 7/1978 | Stavrou et al. | 84/617 |
| 4,157,049 | 6/1979 | Watanabe | 84/620 |
| 4,294,155 | 11/1981 | Turner | 84/682 |
| 4,341,143 | 7/1982 | Minerd | 84/107 |
| 4,348,931 | 9/1982 | Wade | 84/DIG. 4 X |
| 4,350,073 | 9/1982 | Peterson | 84/672 |
| 4,592,262 | 6/1986 | Yang | 84/115 |
| 4,622,878 | 11/1986 | Sharp | 84/DIG. 27 X |
| 5,166,464 | 11/1992 | Sakata et al. | 84/662 |

*Primary Examiner*—William M. Shoop, Jr.
*Assistant Examiner*—Jeffrey W. Donels
*Attorney, Agent, or Firm*—Hill, Steadman & Simpson

[57] ABSTRACT

Classic organ sounds are produced by selecting plural loops of predetermined sound components, and combining the components in accordance with parameters readily adjusted by an operator, which parameters are maintained separately from the musical notes which are being sounded at any given time. In this way, the finishing of the organ sounds may be tailored to circumstances, such as particular organ sound qualities, particular organ styles and the like. Plural microprocessors allow organ sounds to be produced, and varied, in accordance with any desired finishing, under operator control.

21 Claims, 27 Drawing Sheets

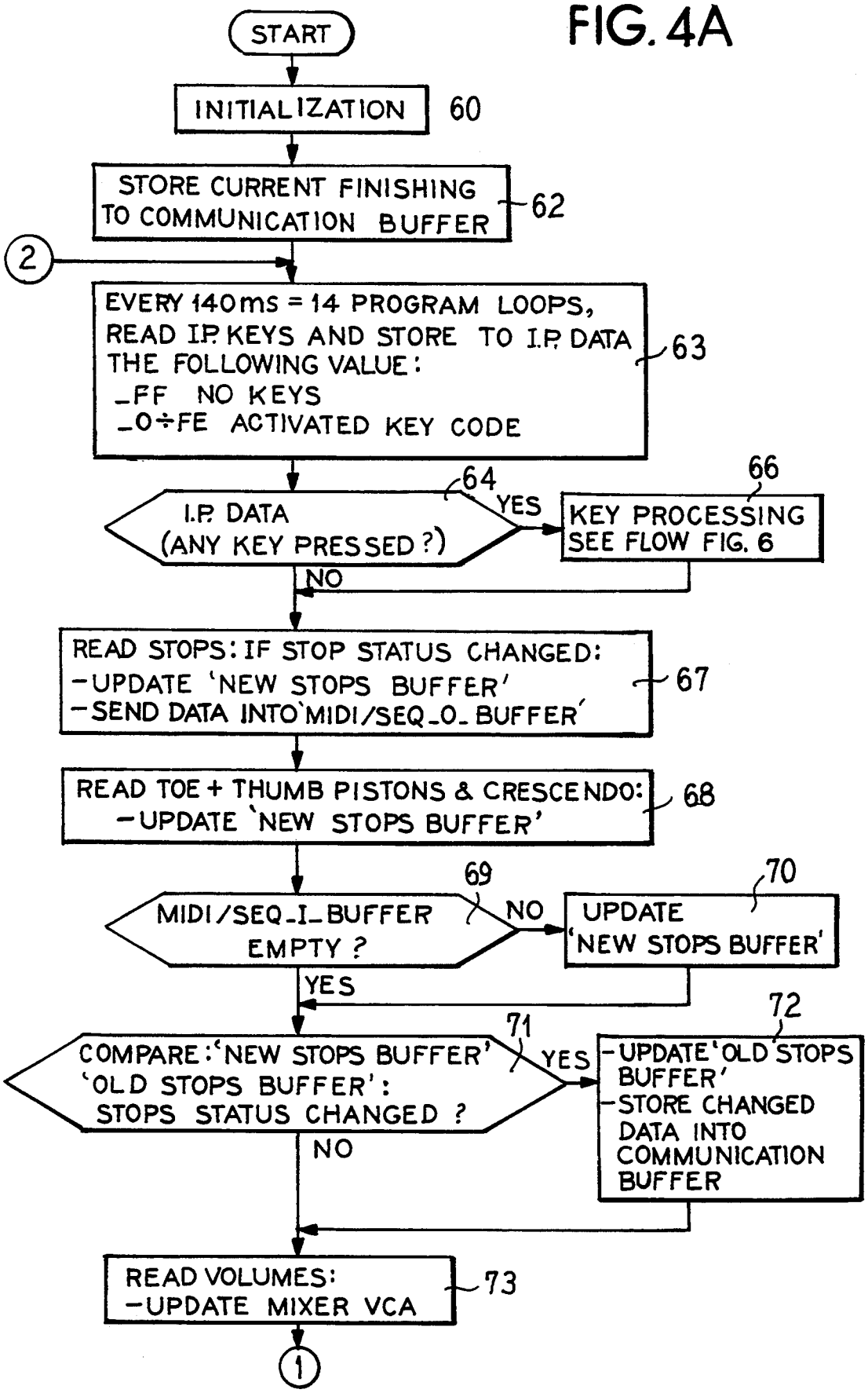
FIG. 4A
START
INITIALIZATION
60
STORE CURRENT FINISHING TO COMMUNICATION BUFFER
62
2
EVERY 140ms = 14 PROGRAM LOOPS, READ I.P. KEYS AND STORE TO I.P. DATA THE FOLLOWING VALUE:
_FF NO KEYS
_0÷FE ACTIVATED KEY CODE
63
I.P. DATA (ANY KEY PRESSED ?)
64
YES
KEY PROCESSING SEE FLOW FIG. 6
66
NO
READ STOPS: IF STOP STATUS CHANGED:
-UPDATE 'NEW STOPS BUFFER'
-SEND DATA INTO 'MIDI/SEQ_0_BUFFER'
67
READ TOE + THUMB PISTONS & CRESCENDO:
-UPDATE 'NEW STOPS BUFFER'
68
MIDI/SEQ_I_BUFFER EMPTY ?
69
NO
UPDATE 'NEW STOPS BUFFER'
70
YES
COMPARE: 'NEW STOPS BUFFER' 'OLD STOPS BUFFER': STOPS STATUS CHANGED ?
71
YES
-UPDATE 'OLD STOPS BUFFER'
-STORE CHANGED DATA INTO COMMUNICATION BUFFER
72
NO
READ VOLUMES:
-UPDATE MIXER VCA
73
1

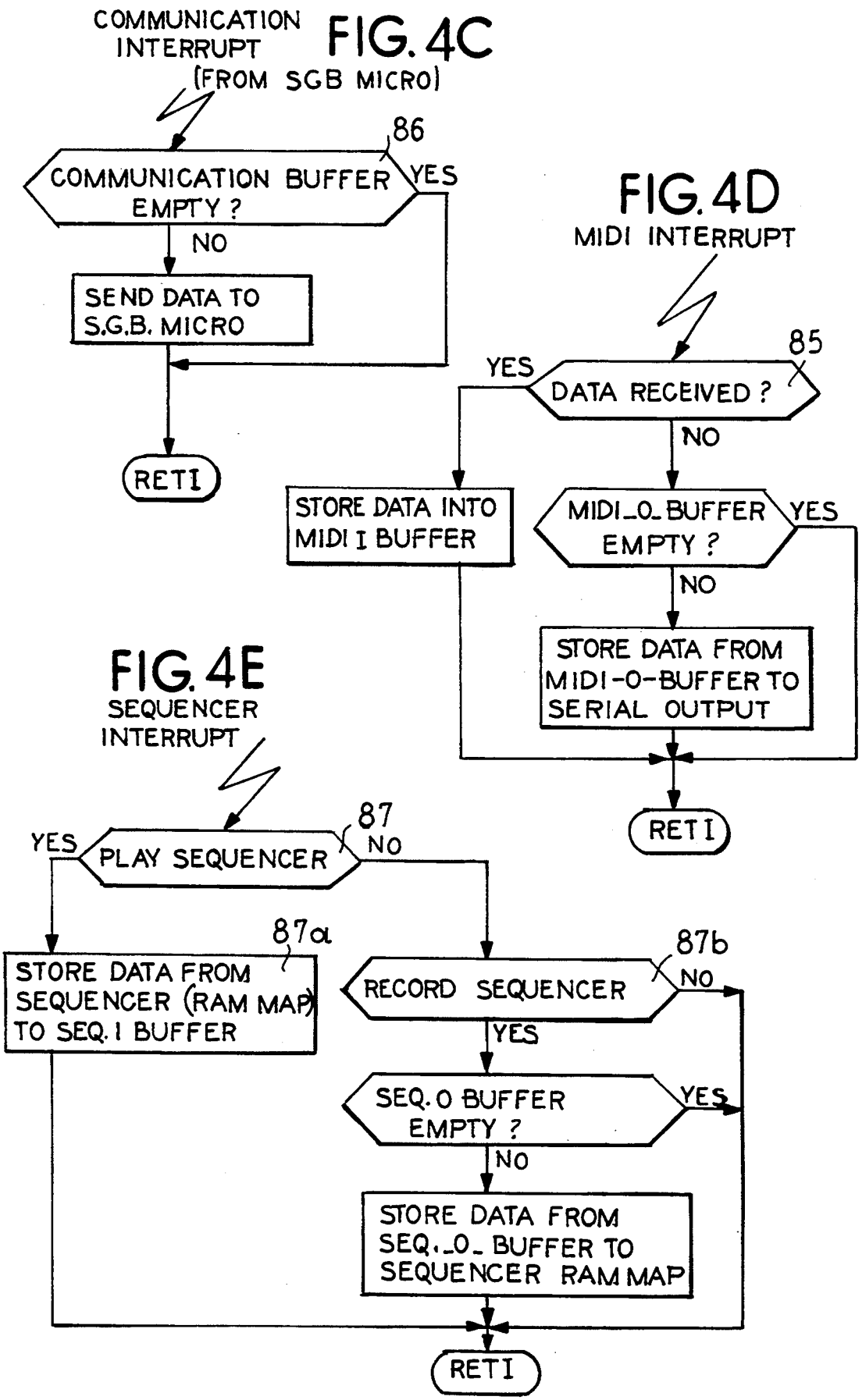
FIG. 4C
COMMUNICATION INTERRUPT (FROM SGB MICRO)
86
COMMUNICATION BUFFER EMPTY ?
YES
NO
SEND DATA TO S.G.B. MICRO
RETI
FIG. 4D
MIDI INTERRUPT
85
DATA RECEIVED ?
YES
NO
STORE DATA INTO MIDI I BUFFER
MIDI_O_BUFFER EMPTY ?
YES
NO
STORE DATA FROM MIDI-O-BUFFER TO SERIAL OUTPUT
RETI
FIG. 4E
SEQUENCER INTERRUPT
87
PLAY SEQUENCER
YES
NO
87a
STORE DATA FROM SEQUENCER (RAM MAP) TO SEQ. I BUFFER
87b
RECORD SEQUENCER
NO
YES
SEQ. O BUFFER EMPTY ?
YES
NO
STORE DATA FROM SEQ._O_ BUFFER TO SEQUENCER RAM MAP
RETI

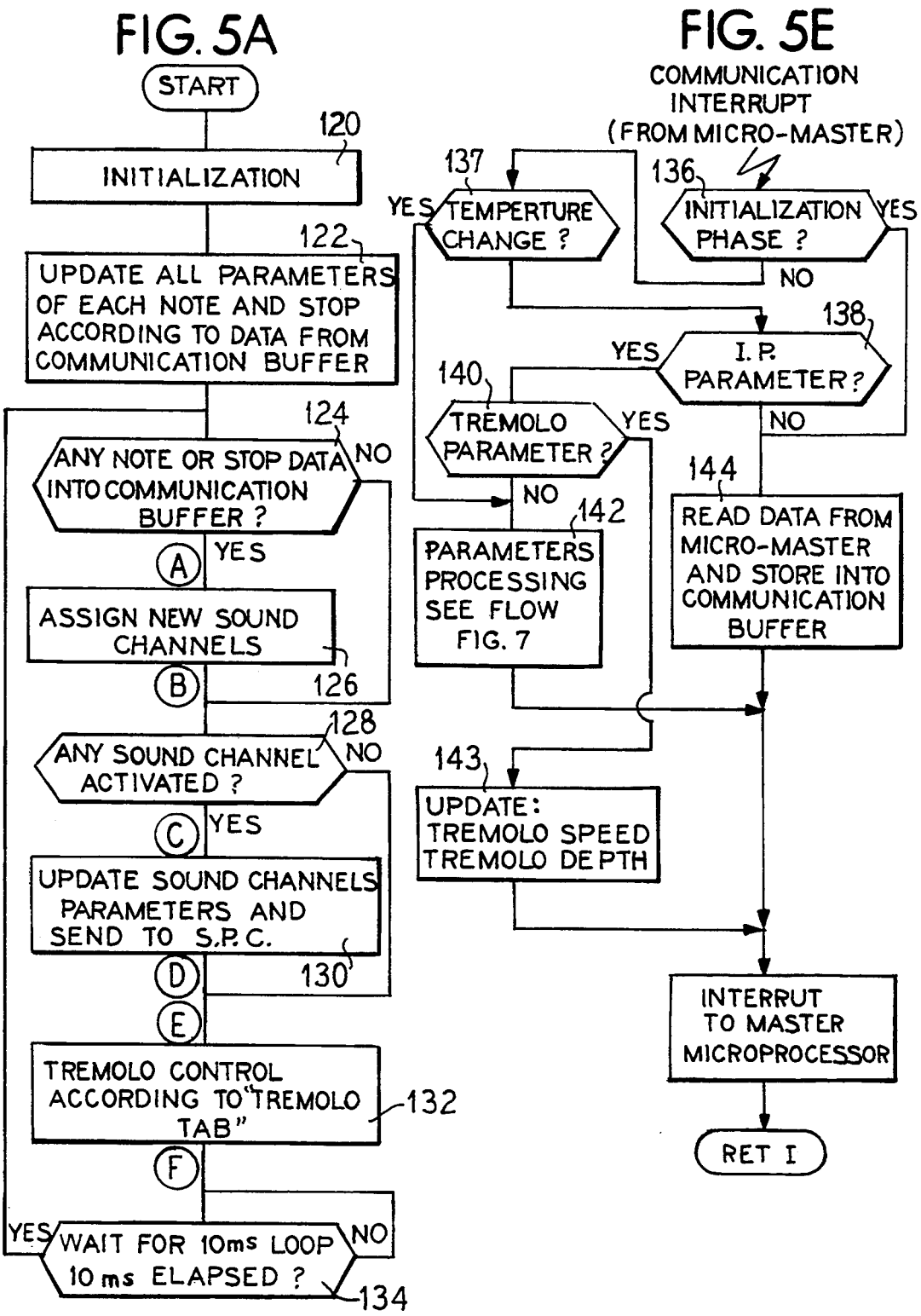
FIG. 5A
START
120
INITIALIZATION
122
UPDATE ALL PARAMETERS OF EACH NOTE AND STOP ACCORDING TO DATA FROM COMMUNICATION BUFFER
124
ANY NOTE OR STOP DATA INTO COMMUNICATION BUFFER ?
NO
YES
A
ASSIGN NEW SOUND CHANNELS
B
126
128
ANY SOUND CHANNEL ACTIVATED ?
NO
YES
C
UPDATE SOUND CHANNELS PARAMETERS AND SEND TO S.P.C.
D
130
E
TREMOLO CONTROL ACCORDING TO "TREMOLO TAB"
132
F
YES
WAIT FOR 10ms LOOP 10 ms ELAPSED ?
NO
134
FIG. 5E
COMMUNICATION INTERRUPT (FROM MICRO-MASTER)
137
TEMPERTURE CHANGE ?
YES
136
INITIALIZATION PHASE ?
YES
NO
138
I. P. PARAMETER ?
YES
NO
140
TREMOLO PARAMETER ?
YES
NO
142
PARAMETERS PROCESSING SEE FLOW FIG. 7
144
READ DATA FROM MICRO-MASTER AND STORE INTO COMMUNICATION BUFFER
143
UPDATE: TREMOLO SPEED TREMOLO DEPTH
INTERRUT TO MASTER MICROPROCESSOR
RET I FIB. 5B
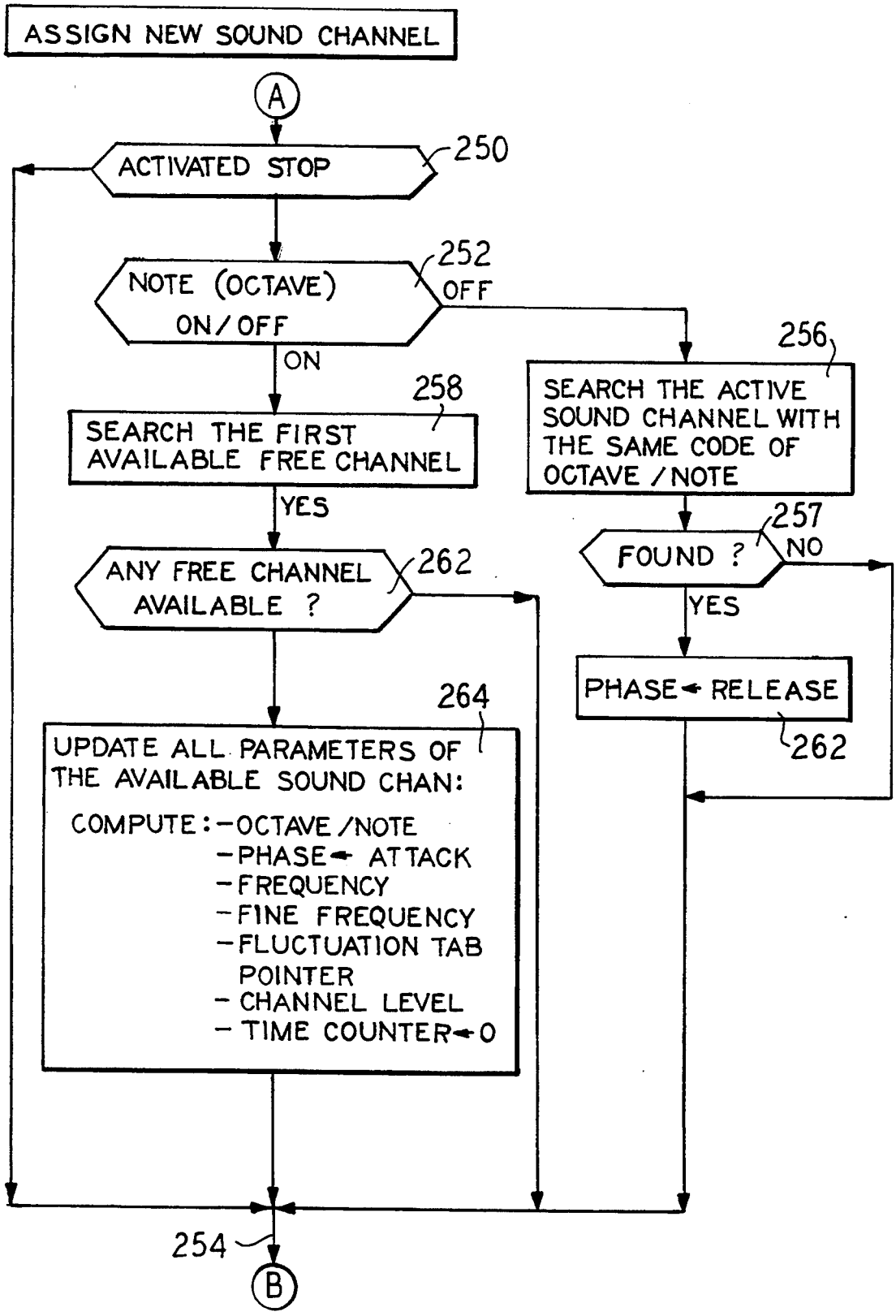

WINDCHEST LAYOUT
SELECT FAMILY:
1-SWELL FLUES
2-SWELL REEDS
3-GREAT FLUES
4-GREAT REEDS
5-PEDAL FLUES
6-PEDAL REEDS
7-CHIMES
96
97
I.P. INC/DEC KEY PRESSED ?
NO
YES
SELECT PANNING:
1-60-50
2-70-30
3-80-20
4-90-10
5-
6-
7-
8-
9-
98
99
UPDATE WINDCHEST LAYOUT PARAMETER, OF ALL STOPS OF THE SELECTED FAMILY, INTO CURRENT FINISHING
AND
STORE THIS PARAMETER INTO COMMUNICATION BUFFER
100
RET

FIG. 7B
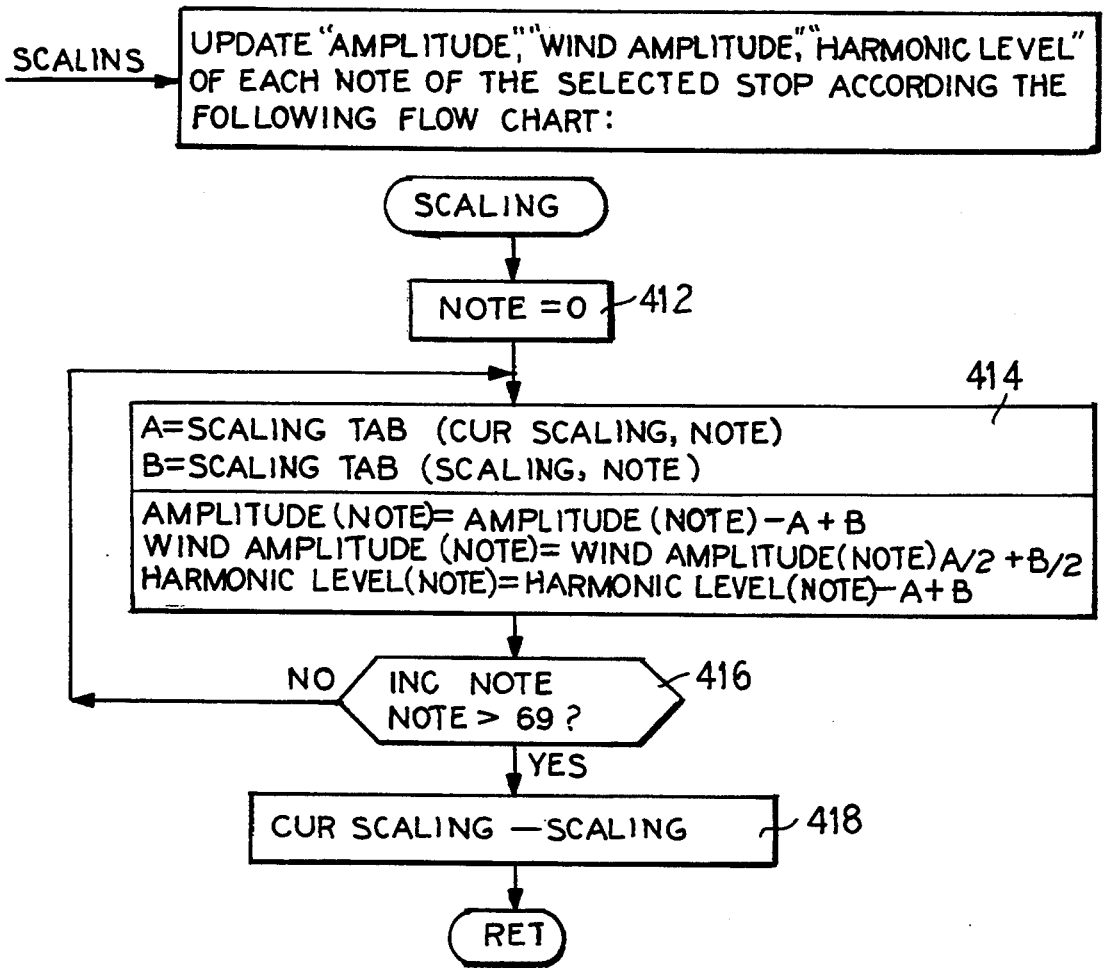
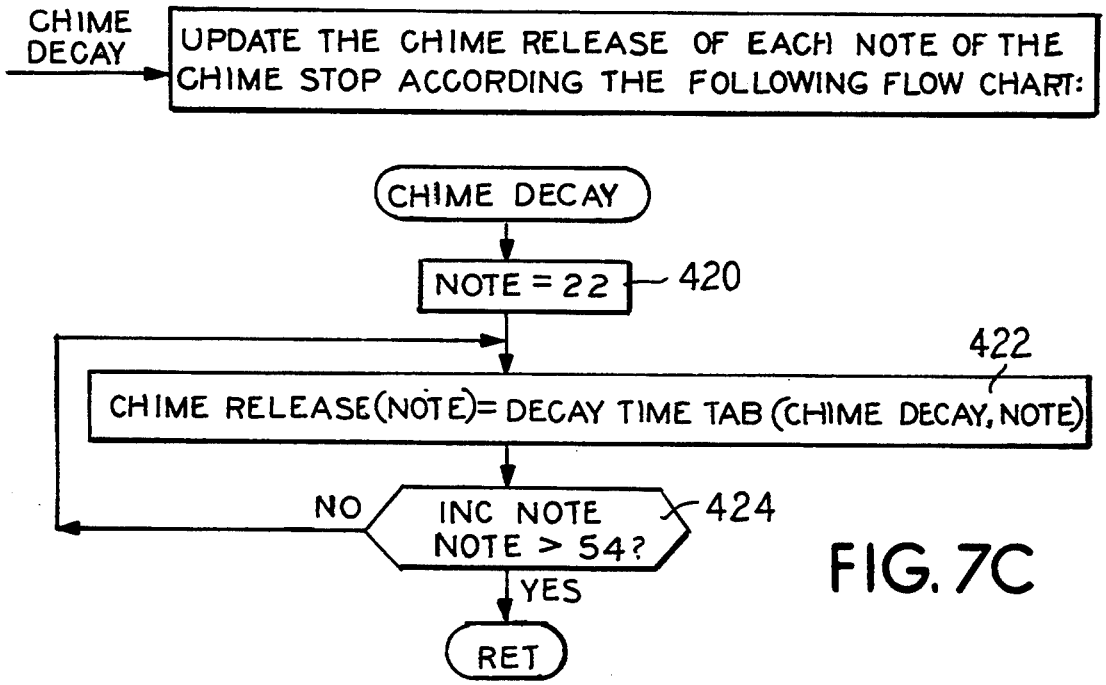
FIG. 7C

FIG. 7D
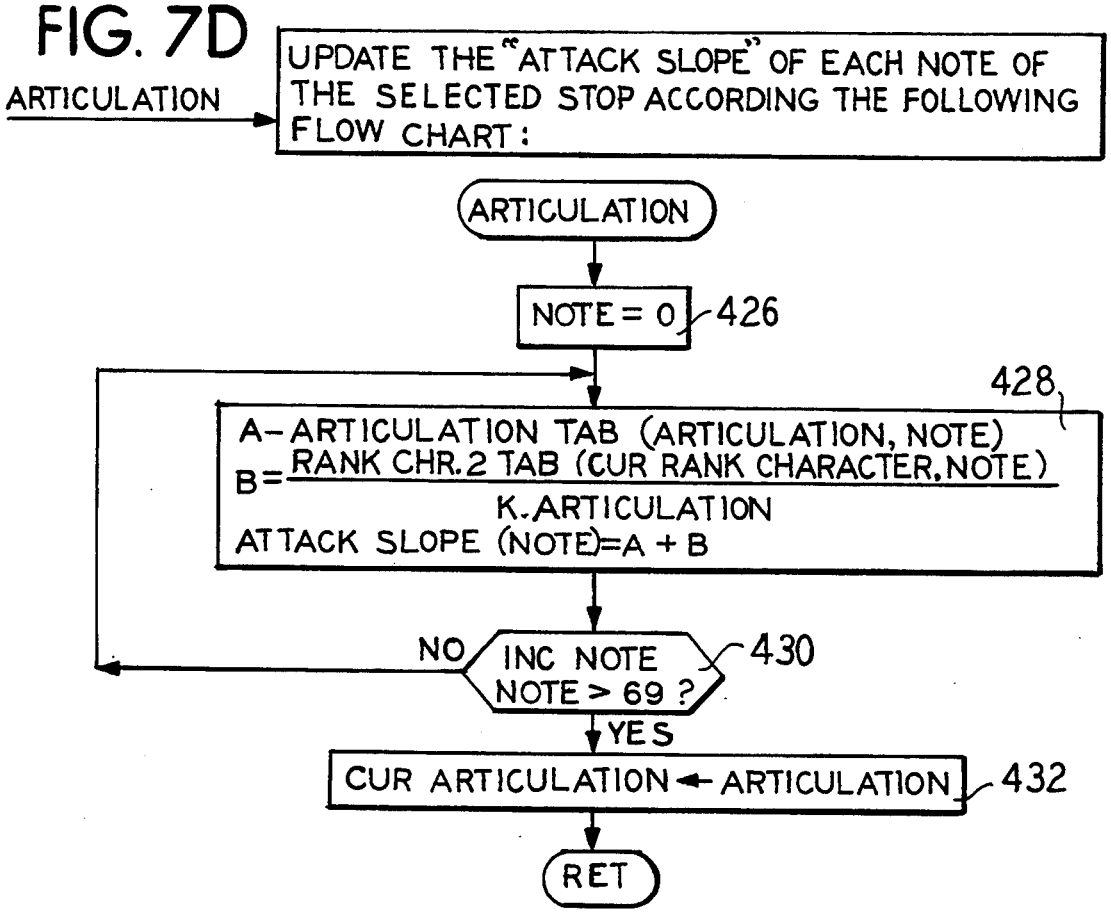
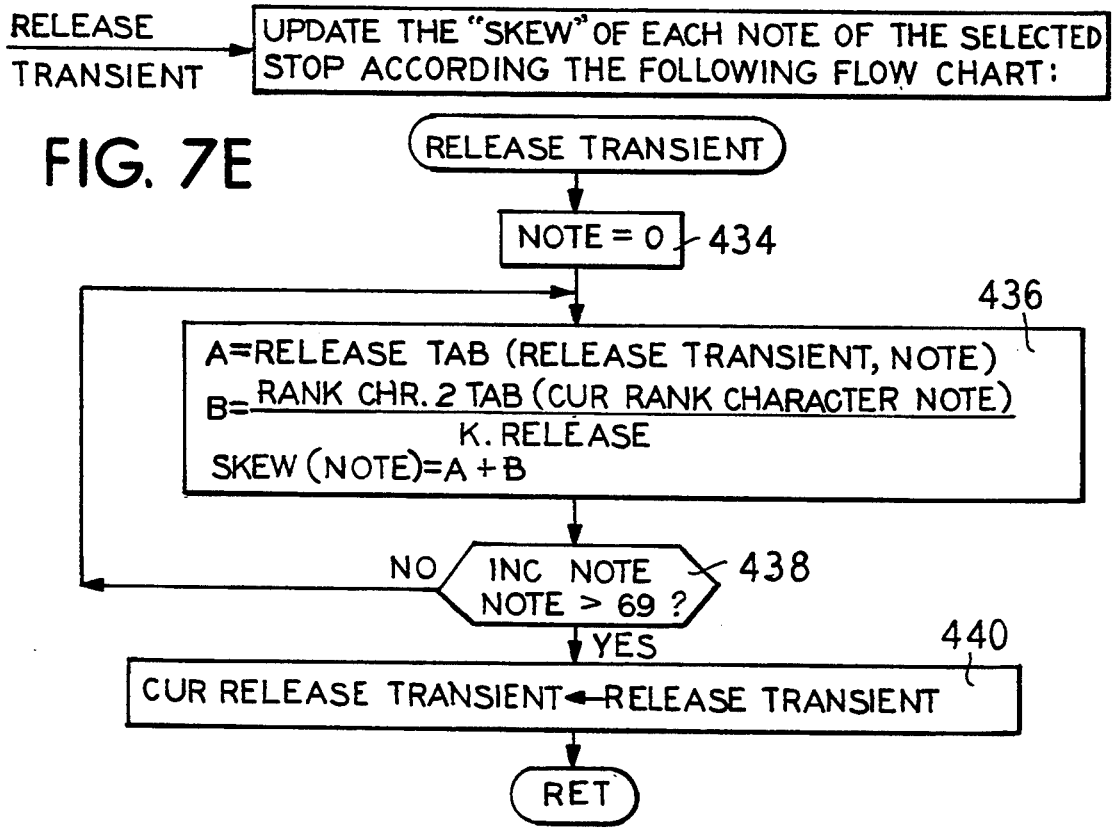
FIG. 7E

RADIO TRANSMITTER BLOCK DIAGRAM

RADIO RECIEVER BLOCK DIAGRAM

DIGITAL CLASSIC ORGAN WITH REMOTE CONTROL FINISHING

FIELD OF THE INVENTION

The present invention relates to apparatus for reproducing sounds of classic organs, and more particularly to a method and apparatus for accurately reproducing such sounds with a variety of operator programmable finishings.

BACKGROUND OF THE INVENTION

Several attempts have been made heretofore to simulate or otherwise reproduce the sounds of classic authentic pipe organs, by electronic means. Many of these attempts have succeeded to a limited extent, but none of the previous attempts to achieve this result have allowed an operator much flexibility in adjusting the "finishing" of the organ, by which the characteristics affecting the sound produced by the organ can be adjusted to a fine degree, either to render the organ consistent with a particular kind of music being played, or to adjust the sound characteristics produced by the organ to the room in which it is located in, or to achieve sound effects closely identical to a classic organ.

In the past, only relatively few characteristics of the organ sounds have been adjustable, with many others necessarily remaining fixed and invariant. This has made it impossible to adjust the fixed parameters, and impossible to "finish" the organ to suit precisely a given set of individual requirements.

Moreover, even the parameters which have been adjustable have had a limited range of adjustment, and so only slight variations from an arbitrary "norm" may be made. This also has prevented satisfactory finishing of the organ sounds.

In the past, the sound characteristics of an organ have been adjustable by means of a technician or the like, but this has been a complicated operation requiring the concerted action of three different persons. One person is necessary to play the organ, another person, stationed in the auditorium or listening space, is required to make judgments as to what sound conditions need to be altered and the way in which they should be altered, and a third person is needed as a technician to make the adjustments to electronic circuits in accordance with the instructions of the person in the auditorium.

It is therefore desirable to provide an apparatus capable of fine adjustments, over a wide range, of all of the characteristics making up organ sounds.

It is also desirable to provide an apparatus and method for allowing the finishing of an organ by a single person, using a remote control which is not only able to cause music to be played by the organ, but also has input means accessible to the operator by which the parameters affecting the quality of the music may be adjusted according to the judgments of the operator.

It is also desirable to provide an automatic tuning mechanism, so that when the frequency of the organ pipes changes in response to a change in temperature, the frequency of the electronically produced sounds will change accordingly, to maintain tuning with the organ pipes.

SUMMARY OF THE INVENTION

It is a principal object of the present invention to provide digital apparatus for reproducing sounds of an organ having means for allowing a single person to adjust the finishing of the organ.

It is further object of the present invention to provide such apparatus in which a plurality of sets of finishing conditions may be stored, each embracing a multiplicity of parameters affecting organ sounds, together with means for causing the current finishing of the organ to conform to any of the stored finishing sets.

Another object of the present invention is to provide means for introducing variations into the sound quality of individual notes, for each of a plurality of different stops of the organ, to more perfectly simulate the sound characteristics of a classic pipe organ.

Another object of the present invention is to provide a random adjustability to certain sound qualities of a classic organ, with means for allowing the operator to adjust the degree of randomness introduced into the sound produced by the organ.

A further object of the present invention is to provide a sound signal for each note, consisting of plural components, and means for adjusting the character individually of each of the plural components making up the sound for each note.

A further object of the present invention is to provide means for storing parameters relating to the finishing of the organ separately from stored sequences of notes and musical patterns, so that either can be modified without affecting the other.

Another object of the present invention is to provide an apparatus in which multiple microprocessors are used, in a hierarchical arrangement, for producing organ sounds, with a multiplicity of characteristics of the sounds being selectively variable over a wide range by modifying stored parameters used by the microprocessors in generating the sound components.

Another object of the present invention is to provided automatic temperature compensation means, for maintaining tuning with the pipes of the organ.

In one embodiment of the present invention there is provided an electronic organ having a plurality of sound generator boards, each of which has a microprocessor for controlling operation of a plurality of sound generator chips, said sound generator chips each being adapted to produce sounds for each note made up of a plurality of components, means for mixing such components by forming a composite of sampled signals, each of said sampled signals representing a single one of said components, means for adjusting the character and amplitude of said components individually, and remote control means under the control of an operator for selectively controlling operation of said sound generator boards, and for allowing the selective alteration of the magnitude of said parameters affecting the quality and amplitude of said components.

By use of the present invention, it is possible for a single operator to adjust the finishing of the organ, by standing in the auditorium and using the remote control unit to cause the organ to sound a prearranged sequence of notes, and to adjust the finishing parameters as such notes are being sounded. An organ which has been finished in this manner, can have all of the parameters affecting the finishing characteristics stored, both in temporary storage where it is accessible to the microprocessors which control operation of the organ, or in permanent storage such as a disk storage device or the like where it can be maintained in nonvolatile form for further reference and use.

BRIEF DESCRIPTION OF THE DRAWINGS

Reference will now be made to the accompanying drawings which:

FIGS. 4A and 4B comprise a flowchart illustrating the program flow of the main microprocessor of FIG. 1;

FIGS. 4C–4E are flowcharts of interrupt routines which can interrupt the program of FIGS. 4A and 4B;

FIG. 5A is a flow diagram of the program flow of each of the microprocessors of the sound generator boards of FIG. 1;

FIGS. 5B–5E are flowcharts showing details of the program of FIG. 5A;

DESCRIPTION OF THE PREFERRED EMBODIMENTS

Figure 1:
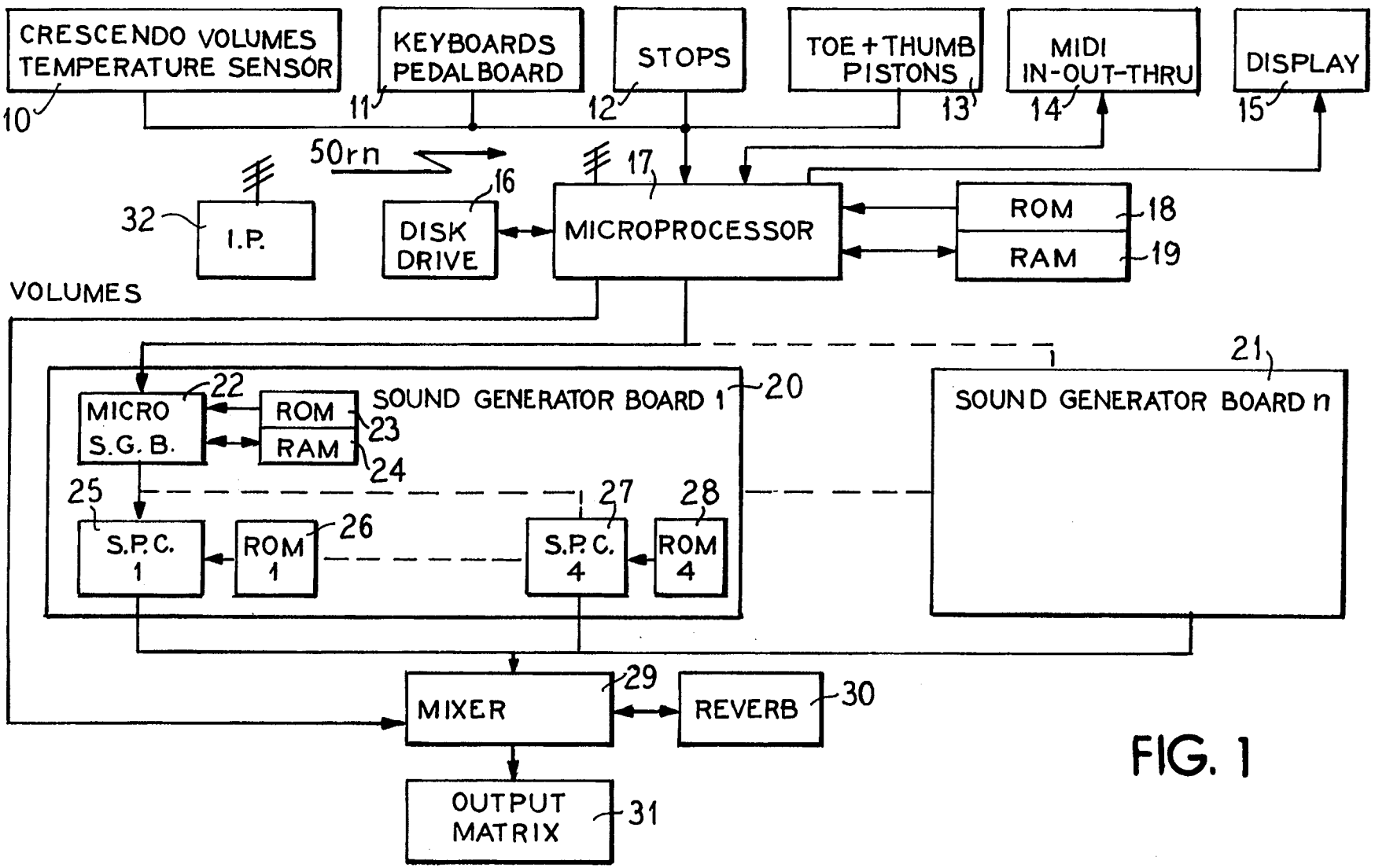
FIG. 1 is a functional block diagram of an organ incorporating an illustrative embodiment of the present invention.

Referring now to FIG. 1, the main components of an organ incorporating the present invention are illustrated in functional block diagram form. The organ is made up of four general parts, comprising first the music interface including units 10–19, which include the keyboards, stops, display unit, and master microprocessor with its associated auxiliary components. The second part is one or more sound generator boards incorporating units 20–28. The third part of the organ is the analog section, including components 29–31, which includes the reverberation unit and the output channel matrix. The fourth unit is an interactive programmer 32 for remotely controlling operation of the master microprocessor.

Typically, the instrument will have a set of organ pipes, which are controlled by the keys of the manuals and/or pedals in the conventional manner. These are also included within the musical interface. One of these pipes has a temperature sensor, for allowing temperature compensation, which is described in more detail hereinafter.

Within the musical interface, the unit 10 includes operator controls for controlling crescendo and volume, and also includes the temperature sensor which is used in connection with a mechanism for maintaining the correct tuning of the organ under various temperature conditions. Unit 11 includes the keyboard units, of which there may be four or more manuals, in addition to a pedal board. Unit 12 comprises the stops, by which various ranks of manuals and the pedals may be selected. Unit 13 includes the toe and thumb pistons, which each designate a particular combination of stops, just as in classic pipe organs. Unit 14 is an MIDI interface, which is a standard musical device interface and is connected to allow input signals in conventional MIDI form for controlling the organ and also for producing output signals in conventional MIDI format, which may be used as input signals for other musical instruments. Unit 15 incorporates a display, by which prompts are made available to the operator, and to show the condition of the various components of the organ on a real time basis.

The interactive programmer has no display (it is composed by push buttons only). In normal operation, the crescendo position (a numeral between 0 and 9) is displayed, and if the temperament is other than normal, the mean tone of the temperament is displayed. Typically, the normal temperament, in which A has a frequency of 440 Hz, is employed, otherwise, when for example, a frequency of 415 Hz is desire for A, with the frequencies of all other notes shifted accordingly, this different temperament is illustrated in this display. The frequency of 415 Hz corresponds to the antique diapason, half a tone under the normal one.

All of units 10–15 are connected with the master microprocessor 17, which has a read-only memory or ROM 18 and a random access memory or RAM 19 available to it for storage of programs and data. In addition, a disk drive unit 16 is connected to the master microprocessor 17 for storing programs and data, and for making stored programs and data available to the microprocessor 17 on demand.

The sound generator boards 20 and 21 are two of a plurality of boards, each of which incorporate four sound processor chips 25 and 27. The chips 25 and 27 are two of four such chips, each provided with its own individual ROM memory 26 and 28, respectively. The sound processor chips 25 and 27 are each controlled by an individual sound generator board microprocessor 22, which has its own ROM 23 and RAM 24 for storage of programs and data. Each of the sound processor chips 25 and 27 is capable of producing a plurality of notes simultaneously, and directing the notes to one of six output channels.

Each of the six output channels is connected through a mixer 29 to an output matrix 31, and a reverberation unit 30 is also connected to the mixer for introducing reverberation to the sound produced by the output matrix. The mixer 29 is controlled by signals from the master microprocessor. The output matrix comprises a plurality of loud speakers positioned at various locations, so that a given wind chest layout can be represented by feeding signals at different amplitudes to various ones of the loud speakers at different locations, to create an audible impression of the location of the sound source (or pipe) producing a selected note. As discussed hereinafter, the wind chest layout is programmable and may be modified by the operator as desired.

The interactive processor 32 constitutes a hand held unit having a plurality of keys accessible to the operator, and means for transmitting a coded representation of the depressed keys to the master microprocessor 17, which is provided with a receiver for receiving signals from the interactive programmer 32 up to a distance of 50 meters. The master microprocessor has a facility for decoding the transmitted signals received from the interactive programmer 32, and for generating an interrupt signal by which the current routine being executed by the master microprogrammer is interrupted, for servicing signals received from the interactive processor 32 on a real time basis. This will be described in more detail hereinafter.

Figure 2:
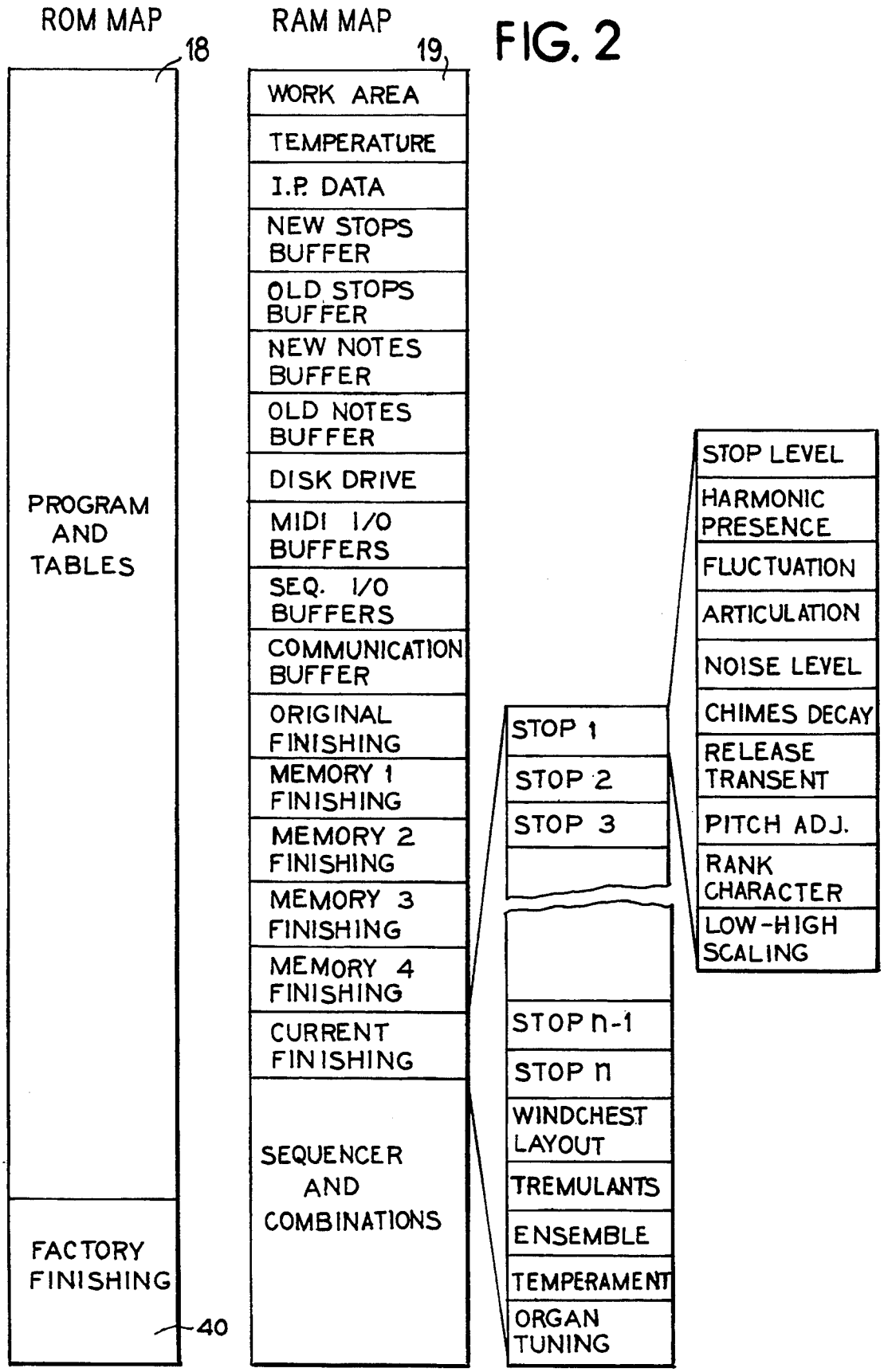
FIG. 2 is a memory map of the memory available to the master microprocessor of FIG. 1.

FIG. 2 illustrates a memory map of the memory available to the master microprocessor, including its ROM 18 and its RAM 19. The ROM 18 has a portion provided for factory finishing data and the major part of the ROM is devoted to the program and data required for operation of the master microprocessor.

The main routine executed by the master microprocessor is illustrated in FIG. 4 and will be discussed in more detail hereinafter. Its storage in the ROM, which is nonvolatile, makes a program available to the master microprocessor on startup, and the factory finishing data 40 is also always available to the microprocessor.

The RAM 19 includes a number of separate areas which are required for operation of the organ, and are designated by the legends in FIG. 2. A work area is provided for temporary storage of calculations, which may be referred to as a scratch pad memory. A temperature location is provided for storing an indication of the current temperature of one of the organ pipes associated with the organ, so that the frequency may be adjusted to compensate for any change in size of the organ pipes due to changes in temperature. Typically, the organ of the present invention will be provided with some fully functional pipes, which operate in the manner of a normal pipe organ. Since the frequencies of these pipes change with temperature, adjustment of the operating frequencies of the digital circuits is necessary to maintain synchronization with the pipe sounds.

The next data storage location is provided for storing data relating to the interactive programmer. The next four locations are provided for storing data relative to new and old stops and relative to new and old notes, respectively. "New" and "old" refer to whether the stop or note has just been selected, via the organ keyboards or pedal board or control panel and not yet been processed by the microprocessor, or whether such note or stop has been processed already.

Another area is provided for the use of a disk drive, by which conventional disk drive commands and data may be stored on a temporary basis. Another area is provided for MIDI input/output buffers, which are also conventional. Another area is provided for input/output buffers for a sequencer, which is used to automatically sound the selected sequence of notes in a predetermined pattern, when the organ is being played in response to the output of the sequencer. Alternatively, the buffer area is used to temporarily store data corresponding to the notes and musical pattern being currently played on the organ, when the sequencer is being used to store a real time performance. Such is conventionally stored on the disk drive unit 16.

A communication buffer area is provided for temporarily storing communications to the sound generator board microprocessors 22.

An area is devoted to the storage of the original finishing parameters, which corresponds to the factory finishing 40 stored in the ROM 18. It is available in the RAM as well as the ROM, in order to provide another copy of this data. The "original finishing", stored in RAM can be modified by authorized operators by means of a software key (in this case it will be different from the factory finishing stored in ROM). The next four storage locations are provided for storing four specific further finishings which have had their characteristics especially selected by the operator. A further storage location is provided for the current finishing, which contains the finishing characteristics controlling operation of the organ in real time, and which may be modified at any time at the will of the operator. The contents of the current finishing area may be stored to a designated one of any of the four preceding areas, to maintain a stored record of the current finishing. It is also possible for the operator to select any of the four finishing memory areas, whereby the contents of the selected memory area is transferred to the current finishing area, to establish any stored finishing as the current finishing parameters. The rest of the RAM area is devoted to the sequencer and combinations.

Each finishing storage area incorporates a number of parameters, as illustrated in the expanded representation of the current finishing area in FIG. 2. Each of the total of n stops of the organ has its own storage area, and a specific set of parameters are stored for that stop. There is a further storage area for the wind chest layout, which identifies a particular wind chest layout for the current finishing. There is a location for storing a parameter relating to tremulants, and a storage location for storing a parameter relating to ensemble, and a storage area relating to organ temperament, all of which will be described in more detail hereinafter. Finally, there is a storage area for storing a parameter relating or organ tuning. This determines how the organ is tuned for this particular finishing. By varying this parameter, it is possible to tune the organ up or down in order to achieve a particular harmony with some other musical source if desired.

The data stored for each of the stops, such as stop 1 of the current finishing is shown in further expanded form in FIG. 2. Each of the stops incorporates an area for storing a parameter corresponding to the stop level or amplitude, a parameter corresponding to harmonic presence, a fluctuation parameter, an articulation parameter, a noise level parameter, a chime decay time parameter, a release transient parameter, a pitch adjustment parameter, a rank character parameter, and a low-high scaling parameter. All of these parameters are provided for each of the n stops, and all these parameters are adjustable by the operator through use of the interactive programmer, as described hereinafter.

Figure 8:
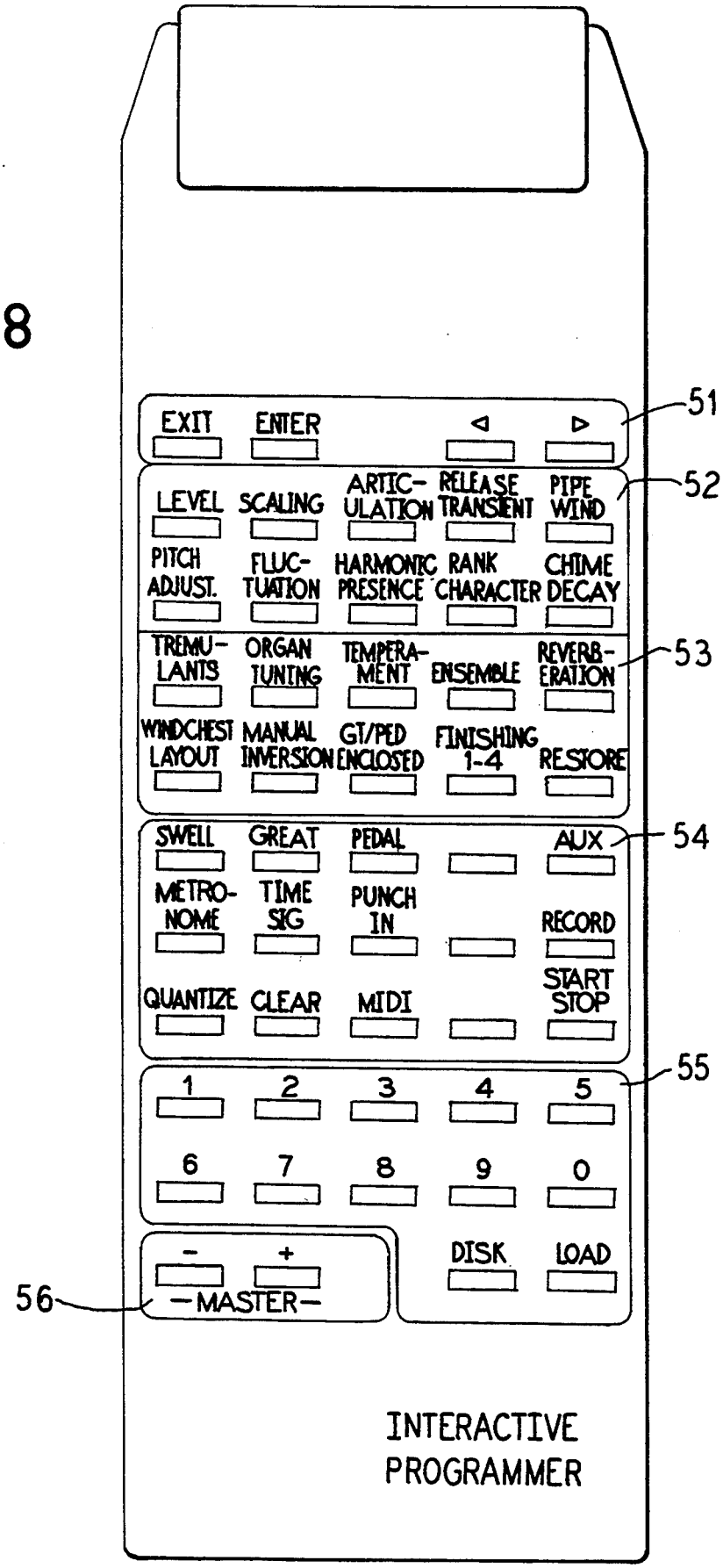
FIG. 8 is a plan view of the keyboard interactive programming device.

FIG. 8 illustrates a plan view of the keyboard of the interactive programmer. It has a plurality of push buttons for selecting various parameters to be modified, and when such a parameter is selected or modified, it always refers to the parameter currently stored in the current finishing area of the RAM 19.

All of the operations are shown in a display area 15 which displays a prompt to the operator and designates the current state of operation of the unit.

The push buttons available on the interactive program are divided into six groups. The first group 51 incorporates the operational buttons, comprising an exit push button, an enter push button, and two push buttons designated with arrows, for increasing or decreasing the value of a parameter associated with a specified function. The exit push button updates and exits the current function of the interactive programmer, and the enter push button provides access to the function currently identified in the display unit 15. The second group 52 includes controls to modify single stops for instrument voicing. These push buttons select respectively the level, scaling, articulation (or chiff), release, pipe wind, pitch adjustment, fluctuation, harmonic presence, rank character, and chime decay parameters. When one of these push buttons is operated, the display illustrates a stop, and the increase and decrease push buttons cause the stop designation to be changed until a particular desired stop is indicated. Then, operation of the enter push button causes the display to display the value of a parameter associated with the push button group 52 for the indicated stop. This value may be increased or decreased using the corresponding push buttons, which automatically update the parameters stored in the current finishing storage location, as described hereinafter. Then, pushing the exit push button returns the display to the stop designation. Then this stop may be selected for further modification, or another stop selected using the increase/decrease push buttons. A similar procedure is followed for each of the other parameters, and therefore will not be described individually in detail. The combination of the enter and exit pushbuttons, with the increase/decrease push buttons is all that is necessary to update any parameter in the current finishing storage location, simply by following the prompts provided to the operator by the display unit. In each case, the nature of the prompt being displayed indicates to the operator the current operation and the key strokes which are necessary to select and modify any parameter, as well as the current value of such parameter.

The level refers to the volume level associated with the selected stop. The sound scaling identifies the volume relationship between the lower octaves, the middle range and the upper octaves. For example, the lower octaves can have lower sound volumes, as the frequency decreases from the middle range, or higher sound volumes instead, and the same can be provided for the upper octaves. The articulation or chiff identifies the quantity of transient which precedes the steady tone, which transient is normal in classic pipe organs. The release identifies a release transient when the steady tone ends, sometimes referred to as "skew". The pipe wind characteristic represents the quantity of pipe wind present while the steady tone is being played. The pitch adjustment allows adjustment of the relationship of tuning between two stops, and allows tuning of undulating stops. The fluctuation parameter allows adjustment of the instability of the steady tone, which occurs naturally in a classic organ. The harmonic presence parameter identifies the amount of higher order harmonics present when a note is sounded. Stops which are associated with reed pipes have variable amounts of high frequency harmonics present. Stops associated with flues do not have any harmonics present. The rank character parameter identifies the degree of individualization of notes within a single stop. By selecting a rank character other than zero, the sound volume of all of the notes of a single stop will be slightly different by a random amount, and the amount of the maximum difference can be selected by the operator. This applies also for: articulation, pipe wind, fluctuation, release transient, pipe wind frequency, sustain timbre address (refer to FIG. 7P). This simulates the minute variations found in a classic organ.

The next section of push buttons on the interactive programmer 53 controls accessory functions as follows. One push button selects tremulant parameters, which define the tremolo velocity and depth. When this push button is operated, the current speed of the tremolo is displayed, which may be increased or decreased with the corresponding push buttons. Then, when the enter push button is operated, the speed is updated and the display shows the current depth. This too may be modified with the increase/decrease push buttons, and the exit push button exits the function.

The next push button selects the organ tuning parameter, which relates to the fine tuning of the instrument, allowing adjustments as fine of 1% of a semitone. The next push button selects the temperament, which determines whether the tuning or the organ is evenly tempered, or tempered according to other conditions or relationships, such as specific harmonic relationships between various notes of the musical scale. The next push button selects the ensemble parameter, which controls the ensemble effect of the stops, viz, the amount of acoustic undulation between the various stops. The next push button selects the reverberation parameter, which controls the digital reverberation selection. The next push button, the first in the second row, selects the wind chest layout, which controls operation of the output matrix, by which various notes appear to be sounded at various locations among a plurality of loud speakers. The next push button selects the manual inversion parameter, which rearranges the stops to allow a first manual to be played to produce the notes normally produced by a second manual, and vice versa. The next push button selects the great/pedal enclosed which determines whether the expression pedal simultaneously controls the great, organ, and pedal sound volumes. Otherwise, these sound volumes are controlled independently. The next push button selects finishing 1–4 which designates one of the four finishing storage areas in the RAM for storage or recall, and the final push button in this section selects restoration of the original parameter values, which brings about a restoration of any of the parameters selected in section 52 to its original condition.

The next section 54 incorporates push buttons which control the sequencer and the MIDI channel selection. The first three push buttons identified as swell, great, and pedal, selectively activate or deactivate these three sections of the organ. The push button designated AUX controls activation or deactivation of an auxiliary section, which may, for example, be connected to another instrument, via a MIDI connection. The first push button in the second row of this area selects metronome functions, which controls the speed of sounding of the organ notes in response to input signals from the sequencer.

The time signature push button selects various available time signatures, such a $\frac{3}{4}$ or 4/4, etc. The punch-in push button is provided for correcting recording errors when necessary. The record push button activates the sequencer for recording and subsequent playback.

The quantize push button is provided for adjusting metric imperfections in recordings, and the clear push button is provided for cancelling some or all existing tracks of the sequencer. The MIDI push button is provided for MIDI channel selection, and the start/stop push button is provided for starting and stopping operation of the sequencer.

The next section 55 incorporates push buttons labelled 0 through 9, a push button labelled disk, and a push button labelled load, for controlling operation of the floppy disk drive. The numerical push buttons select one of several available files or memory segments available on the disk. The disk push button selects operations on the disk, and the load push button effects a high speed recall of a recording from the disk from a designated memory segment.

The sixth section 56 of the push buttons on the interactive programmer includes push buttons labelled − and +, which control the general volume of the organ. By this means, the general volume is increased or decreased in accordance at the will of the operator.

Figure 4B:
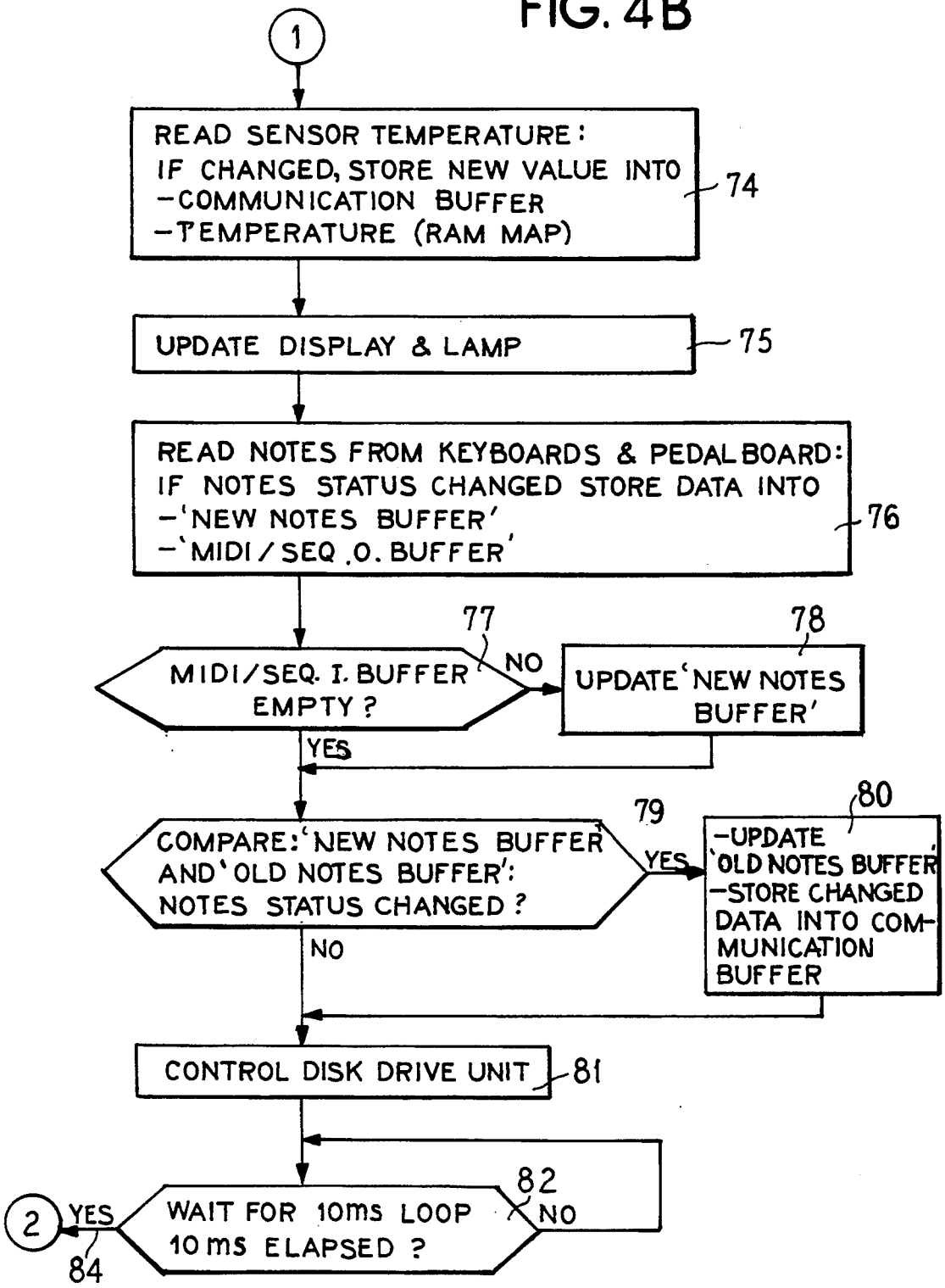

The main program flow executed by the master microprocessor is illustrated in FIGS. 4A–4B. When the organ is first powered up, unit 60 receives control, which initializes the condition of the organ parameters to a specified initial condition, which sets the parameters in the current finishing area (FIG. 2) according to the factory finishing stored in location 40 of the ROM. Then unit 62 receives control, and the data from the current finishing area is transferred to the communication buffer in the RAM, so that it can be made available to the microprocessors of the sound generator boards. Unit 63 reads data received from the interactive programmer 32, and sets a flag and a register accordingly. Then control passes to unit 64, which determines if any interactive processor key has been pressed. If so, unit 66 processes the key by adjusting the parameter which results in alteration of a parameter in the current finishing area of the RAM (FIG. 2). The processing by which this is done is described in more detail in connection with FIG. 6. Then control passes to unit 67. If no interactive programmer key has been depressed, control passes directly to unit 67. Unit 67 determines whether there is any change in the status of a stop, by scanning the stop switches mounted on the organ console. If so, the changed data is loaded into the MIDI/SEQ output buffers.

Unit 68 reads each of the toe and thumb pistons, which are available on the organ console to the operator for designating plural combinations of stops, and all of those which are operated result in changes of parameters within the "new stops" buffer area.

Then unit 69 inspects the buffer storage area provided for the MIDI/sequencer interface. If it is not empty, the unit 70 updates the "new stops" buffer and passes control to unit 71. Otherwise, control passes directly to unit 71.

Unit 71 compares the "new stops" and "old stops" buffers. If they are identical, control passes to unit 73. Otherwise, the different data is loaded into the communications buffer by unit 72, the "old stops" buffer is updated to contain the new stop data, and control passes to unit 73.

Unit 73 reads the volume data and updates the signals controlling the mixer 29 (FIG. 1). Then control passes to unit 74 (FIG. 4B) which reads the temperature signal from the temperature sensor, and compares it with the value stored in RAM (FIG. 2). If the temperature has changed, the stored value is updated and a new value is placed in the communication buffer. Then unit 75 updates the display and indicator lamps on the organ console.

Then control passes to unit 76, which reads the notes currently operated, by scanning switches controlled by operation of the keys of the various keyboards of each manual, and determines whether their status has changed, namely whether a note has been depressed or released. If a change is recognized, the changed data is loaded into the "new notes" buffer and to the MIDI/-SEQ output buffer. Then, control passes to unit 77. Unit 77 inspects the MIDI/SEQ input buffer and if it is not empty, the "new notes" buffer is updated by unit 78. Unit 79 then compares the "new notes" and "old notes" buffers. If they are not identical, the new data is loaded into the communication buffer by unit 80. Unit 81 controls the disk drive unit, executing any commands entered by means of the interactive programmer. Finally, control passes to the unit 82, which determines whether a 10 ms time interval has elapsed since the last entry into the unit 82. If not, control is retained in unit 82 until 10 ms elapses, after which control is returned via line 84 to the unit 63. Then the sequence of operations incorporating units 63–82 is repeated.

The provision of the 10 ms loop of unit 82 provides a regular sequencing of the steps in the main program flow, irrespective of the time required to execute the individual operations within each loop. This assures a more regular operation.

The program flow illustrated in FIGS. 4A–4B may be interrupted by an interrupt signal generated by a microprocessor on any one of the sound generator boards, as shown in FIG. 4C. When such an interrupt is received, control passes immediately to unit 86, which determines whether the communication buffer associated with that sound generator board is empty. If so, control returns immediately to the main program flow, at the point where it was interrupted. Otherwise, the data in the communication buffer is sent to the interrupting sound generator board microprocessor, which produces one or more notes with the characteristics in accordance with the current finishing. The data sent is that inserted into the communication buffer by units 62, 72, 74, 80, 94, 65 and 99.

Interrupts may also be originated by a MIDI unit (FIG. 4D) or by the sequencer (FIG. 4E). If the former, unit 85 determines whether MIDI data has been received, and then stores it in the MIDI input buffer. Otherwise, if the MIDI output buffer is not empty, the data is sent to the serial output, for use by a MIDI device, and control returns to the main program. If the MIDI output buffer is empty, control returns directly. When a sequencer interrupt is received, control passes to unit 87, which determines whether the sequencer is in its play mode. If so, unit **87*a* stores the data received from the sequencer into the sequencer input buffer, and returns control to the main program. Otherwise, the unit 87*b*** determines if the sequencer is in its record mode. If not, control returns directly. Otherwise, if the sequencer output buffer is not empty, its data is stored to the sequencer data area in ram.

Figure 6A:
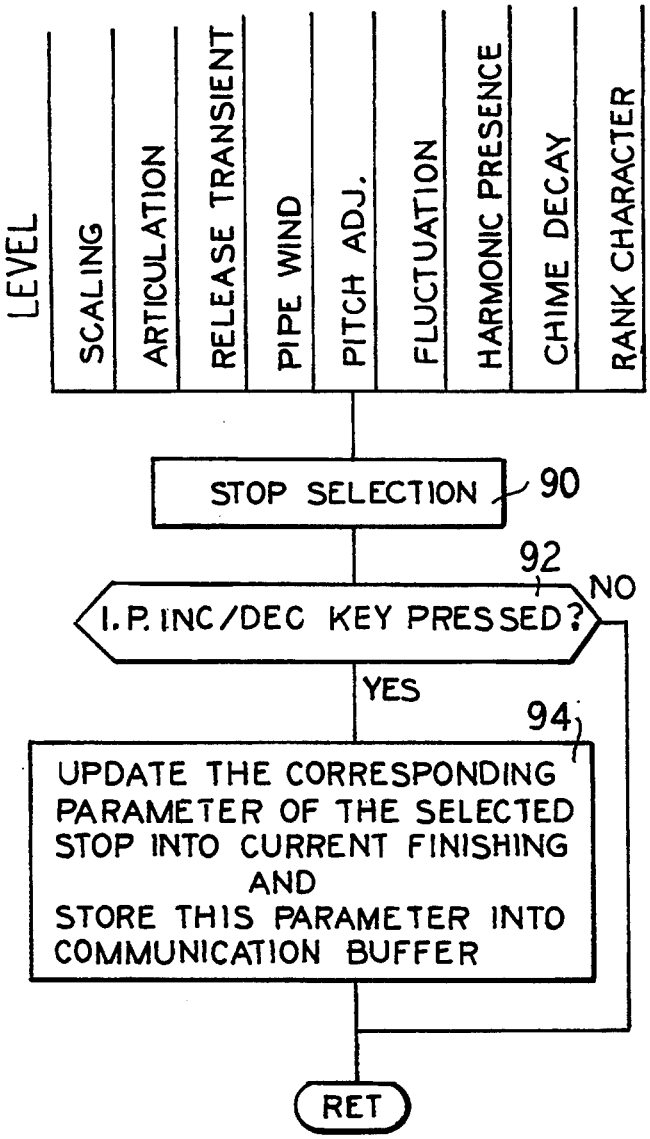
FIGS. 6A–6C are flowcharts of operations conducted in connection with the processing of keys which are depressed on the interactive programmer of FIG. 1.
Figure 6C:
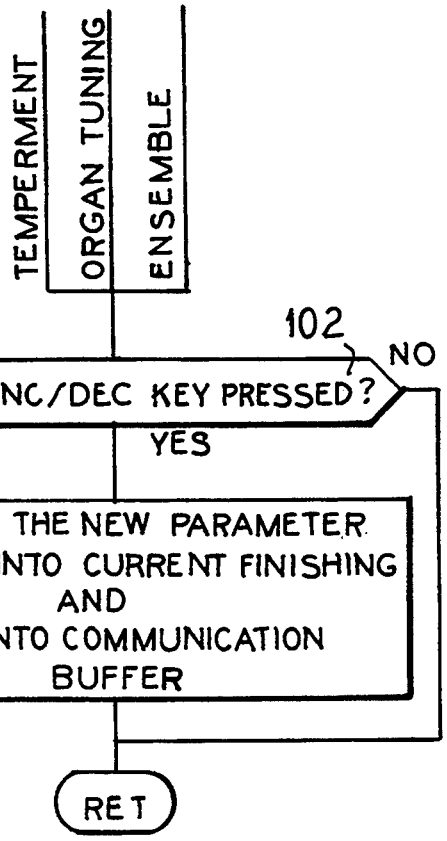
Figure 6B:
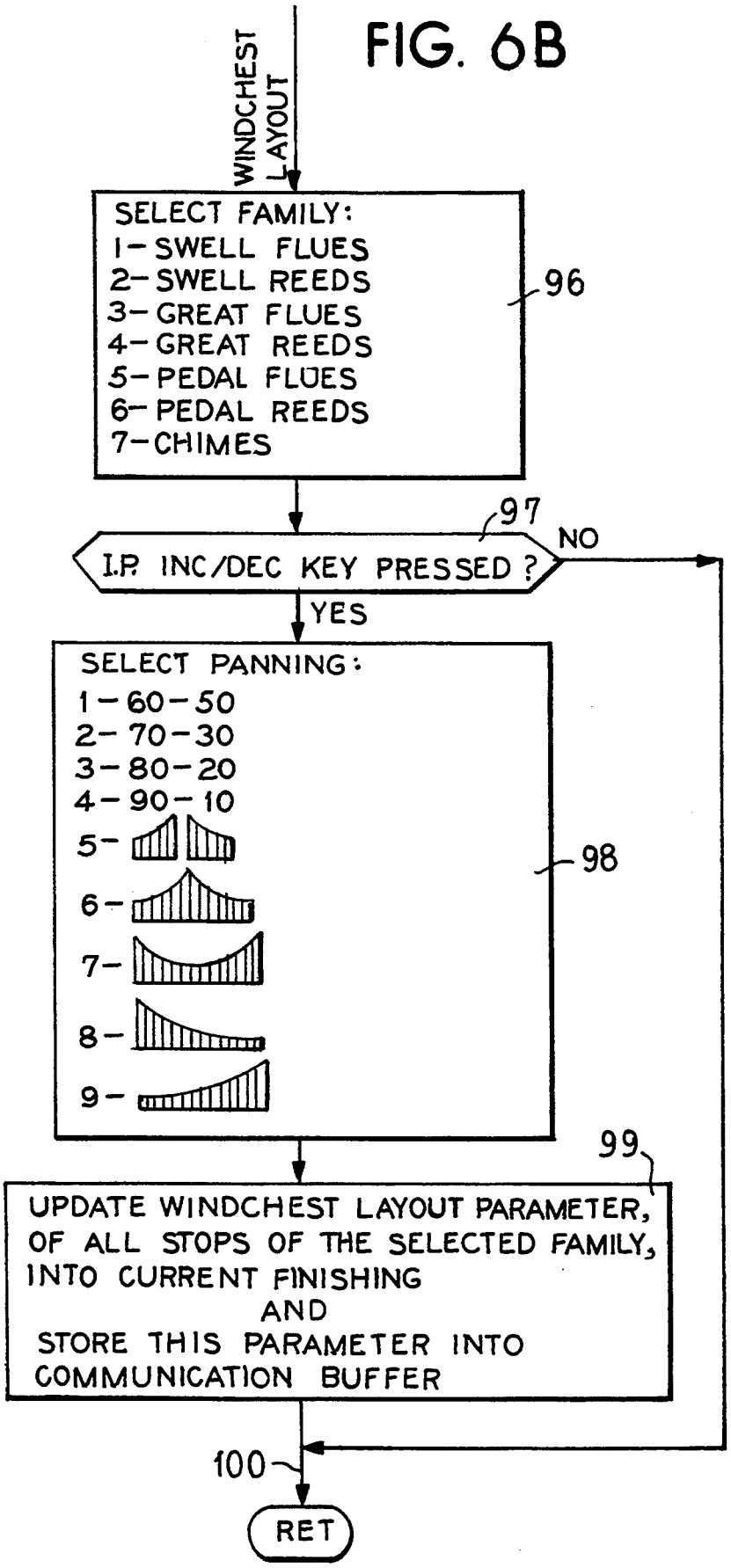

Referring now to FIGS. 6A–6C, flowcharts illustrating processing of depressed keys of the organ console or on the interactive programmer are illustrated, which is used by unit 66 of FIG. 4A.

When a console key or an interactive programmer key is recognized as being depressed, control passes to either unit 90, unit 96 or unit 102, in accordance with the key which is depressed. If the depressed key is a push button relating to level, scaling, articulation, release transient, pipe wind, pitch adjustment, fluctuation, harmonic presence, chime decay, or rank character, control passes to unit 90, which selects the area within the RAM 19 corresponding to this parameter of the current selected stop (FIG. 2) within the current finishing storage location. Then control passes to the unit 92, which inspects whether the increase or decrease key of the interactive programmer is depressed. If not, control returns to the main program. Otherwise, control passes to the unit 94, which updates the appropriate parameter of the selected stop into the current finishing area, and this parameter is then loaded into the communication buffer where it is available to the sound generator boards.

FIG. 6B illustrates the routine which is executed in the windchest layout operation. When this is recognized, control passes to unit 96. Unit 96, in cooperation with the interactive programmer, with prompts displayed on the display screen, selects one of seven families for which the windchest layout is specified. Six of these families are the flues and reeds for the swell, great and pedal, and the seventh is the windchest layout for the chimes. The layout may be different for each family, if desired. When a family has been selected, control passes to unit 97, which determines whether the increase/decrease key is depressed on the interactive programmer. If not, control returns to the main program via line 100. Otherwise, control passes to unit 98, which allows the operator to select one of several different layouts for the windchest layout. The first four select one of four different ratios of stereo separation between the left and right, respectively. A ratio of 50—50 provides that left and right outputs are equal, and so there is no stereo effect. A ratio of 90–10, on the other hand, provides for 90% stereo separation.

When selections five through nine are selected, the sound from the loud speaker is located on the left and right are mixed according to the pitch of the note being sounded. Unit 98 of FIG. 6B illustrates diagrammatically the relationship between the apparent sound position (along the horizontal axis) and the apparent length of the pipe producing the sound. In windchest layout number six, the notes of the highest pitch (produced by the shortest pipes) are produced at the right and left extremities of the windchest space. The apparent position of longer pipes is toward the center. This layout is accomplished when two loud speakers are used, for example, by sounding the highest notes only with the left speaker or the right speaker, with notes of lower frequencies being sounded by a ratio between the left and right speakers. As the frequency decreases from highest to lowest, corresponding to increasing length of pipes the proportion of sound produced by the left and right speakers is proportioned more and more equally until it reaches the equality ratio, corresponding to the longest pipes.

When layout number five is selected, odd numbered notes are positioned at the lefthand side (sending these to one loudspeaker only) and some numbered notes are positioned on the right end side.

Layout number seven is the inverse of layout number six, in which the highest notes are sounded equally between left and right speakers with the apparent position at the center between them, with the lowest frequency notes corresponding to the longest pipes sounded exclusively by the left or right speaker. Intermediate notes are sounded with sound volumes proportionally divided between the left and right speakers.

In each of the layouts five through seven, the arrangement is symmetrical, in which odd numbered notes are positioned at the lefthand side and even numbered notes are positioned on the righthand side, arriving at a symmetrical relationship. In layout numbers eight and nine, the lowest notes are sounded exclusively by one speaker and the highest notes by the other, with varying ratios in between. The lowest notes may be on the left as in layout number 8, or on the right as in layout number nine.

When one of the layouts is selected by operation of unit 98, in cooperation with the push buttons depressed by the operator on the interactive programmer, control passes to unit 99, which updates the windchest layout parameter for every stop of the selected family. This data is stored in the current finishing storage location. Then the parameter is transferred to the communication buffer, where it can update the SPC of the sound generator board. The stored parameter then designates the proportion of sound which is to come from the left and right speakers, and this proportion is different for every note, in order to execute the layouts which are illustrated at 98.

If the push button on the interactive programmer is the one associated with temperament, organ tuning or ensemble, control passes to unit 102 which determines whether the increase or decrease key is depressed, and if so, the new parameter is updated and stored in the current finishing in the communication buffer areas. Then control returns to the main sequence. Otherwise, control returns immediately to the main sequence.

It is apparent from the above description, that all of the parameters affecting the finishing of the organ may be modified by means of the interactive programmer, which the operator may use at a distance from the organ up to 50 meters. The main program sequence recognizes depression of a key of the interactive programmer, and updates the appropriate storage location within the current finishing when the increase/decrease keys are operated. Since the operator can control operation of the sequencer by means of the interactive programmer, it is not necessary to have an organ player present at the keyboard or manual of the organs in order to produce sounds, nor is it necessary to have a third person adjust the values of electronic components in accordance with a judgment of the listener or observer in the auditorium area. Accordingly, the entire finishing can be accomplished by means of a single person.

As described above, the individual notes are produced by the sound processor chips on the sound generator boards, and they are controlled by the microprocessors 22 in each sound generator board. The master microprocessor 17 generates an interrupt when it has new data ready, and the sound board microprocessors 22 each generate an interrupt when it is ready to receive new data from the master microprocessor 17.

Figure 3A:
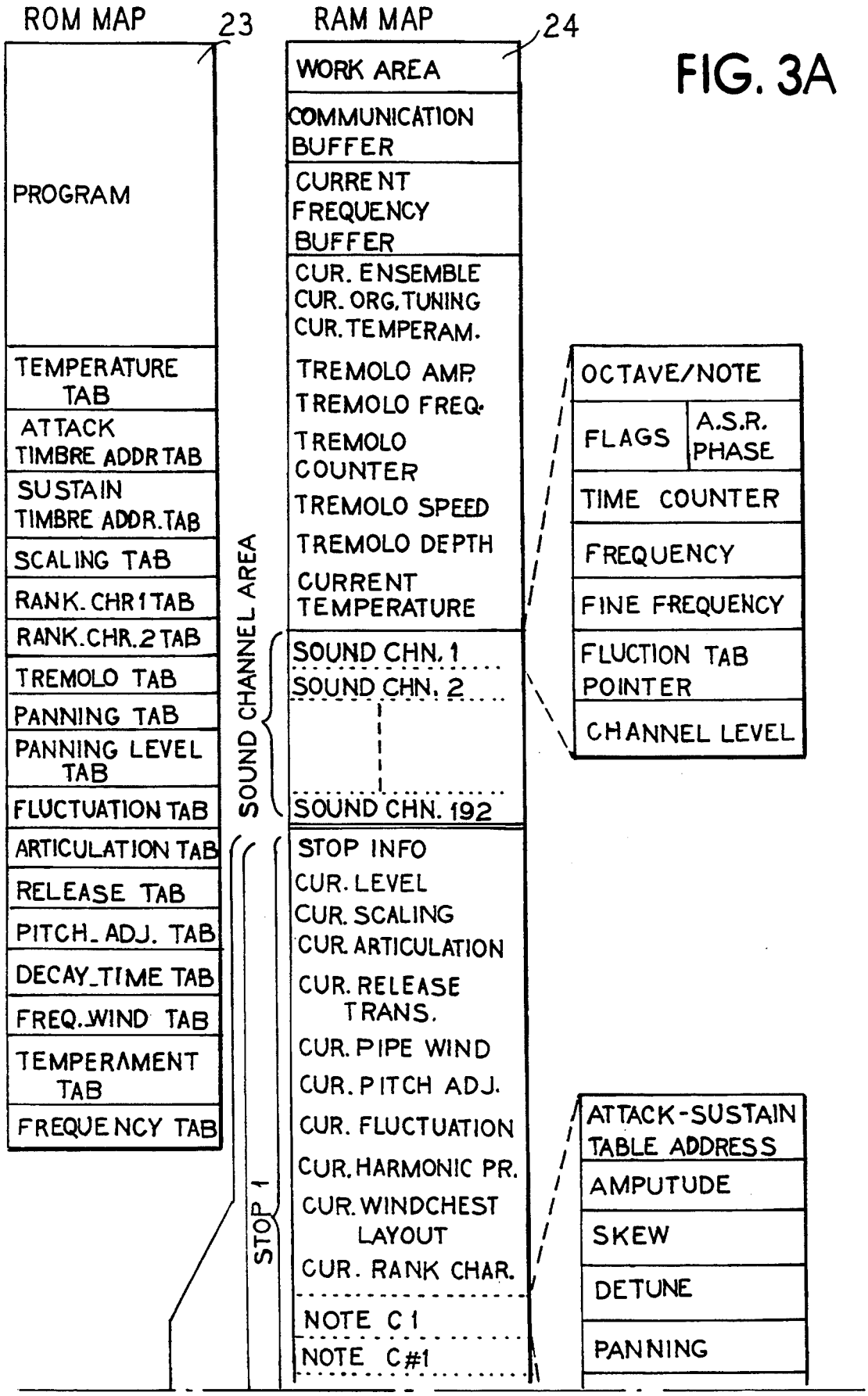
FIG. 3 is a memory map of memory available to a microprocessor within one of the sound generator boards of FIG. 1.
Figure 3B:
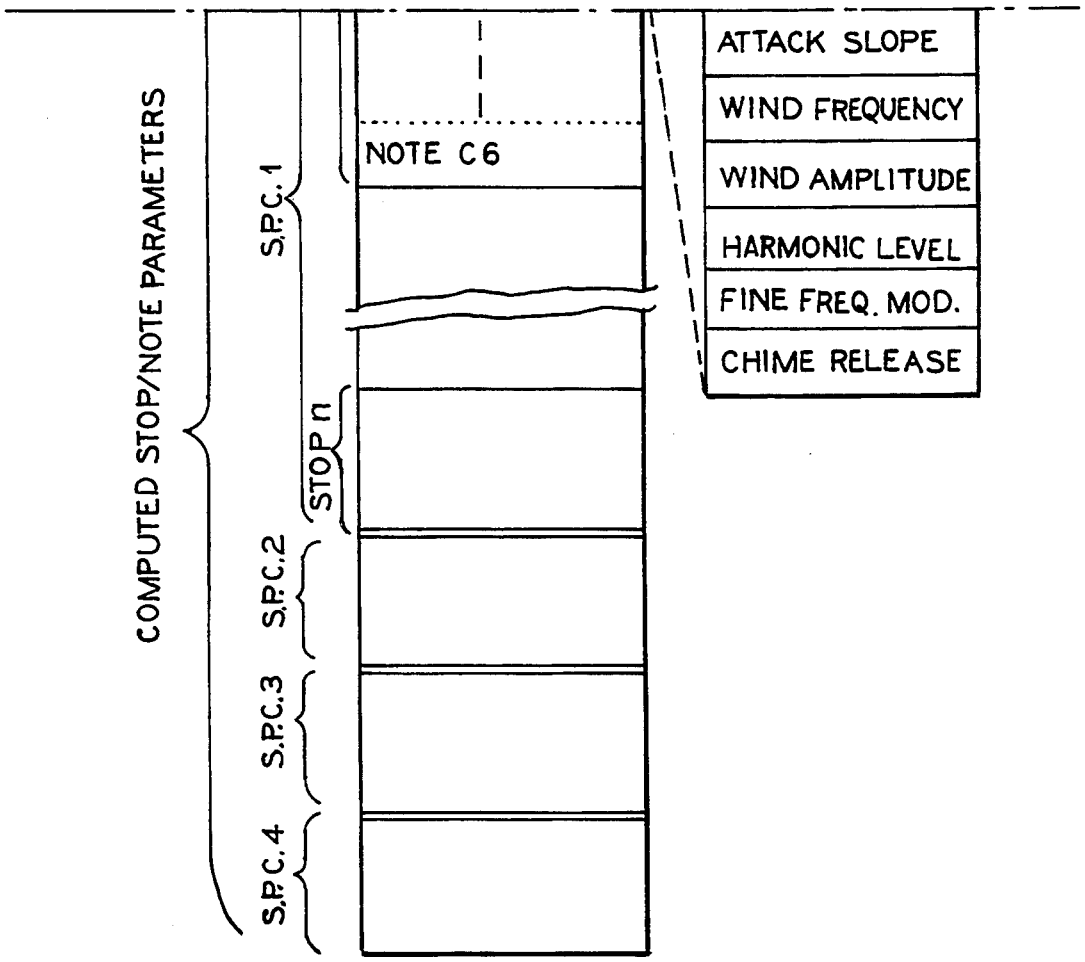

FIG. 3 illustrates a map of the memory available to each of the microprocessors of the sound generator boards. The ROM 23 includes an area for the main program routine executed by the sound generator board microprocessor, and a number of tables which are used in connection with the generation of the individual notes. The tables identified in FIG. 3 are the temperature table, the attack and sustain address tables, the scaling table, two rank character tables, the tremolo table, the panning table, the panning level table, the fluctuation table, the articulation table, the release table, the pitch adjustment table, the decay time table, the wind frequency table, the temperament table, and the frequency table. The data in all of these tables are fixed, and are referred to in the course of operation of the main program routine of the sound generator board microprocessor as described hereinafter. The RAM 24 available to the sound generator board microprocessor has a number of areas which are indicated in FIG. 3. The first area is a work area, which is available as a scratch pad for intermediate calculations and like. The next area, is a communication buffer, which receives data from the master microprocessor. A storage area is provided for the current frequency buffer, which identifies the current frequency being produced. The next area identifies the current ensemble parameter, the current organ tuning, and the current temperament. The next five areas store data related to tremolo. These are amplitude, frequency, a counter parameter, and parameters for speed and depth. All of these parameters stored in the RAM 24 correspond to the parameters identified above in connection with the current organ finishing, which are adjustable under control of the interactive programmer; another position is provided to store the current value of the temperature measured on the "real pipes".

The next area of the RAM 24 is the sound channel area, which incorporates separate data areas for 192 sound channels. Each of the individual sound channels have storage areas as indicated in the expanded portion of FIG. 3. A storage area is provided for the octave and note associated with a given sound channel, and a flag area is provided for setting or resetting various flags to designate the current conditions, including the current phase of the channel, viz., attack, sustain or release. A storage area is provided for a time counter, by which elapsed time is calculated, and this is referred to from time to time during the program operation. Two additional storage locations are provided for the frequency and fine frequency, which relate to the frequency required for the sound being generated at the current time. The next storage area is provided for a pointer pointing to a location in the fluctuation table in the ROM 23. Each time the fluctuation function is performed, this pointer is updated, so that the next entry in the fluctuation table is used during the subsequent performance of the fluctuation function. The fluctuation table is a table of random numbers, as are several of the other tables, such as the rank character-1 and rank character-2 tables. In this way, fluctuations are different and pseudo random, each time a fluctuation function is performed. This allows variations which closely simulates operation of a classic organ. The final storage location for each of the 192 sound channels is the channel level, which identifies the volume of sound associated with that channel.

Following the storage locations for the 192 sound channels, storage locations are provided for each of the four sound processor chips. Each sound processor chip has a separate storage location for each of the n stops, where n is the total number of stops provided. For each of the stops, a storage area is provided for general stop information, and individual storage areas are provided for each of the notes associated with that stop. The data stored for each note is indicated in expanded form in FIG. 3. This includes a storage area for the beginning addresses of the attack and sustain tables, a storage location for the parameter identifying the stop amplitude, a skew parameter, a detune parameter, a panning parameter, an attack slope parameter (which specifies the slope of the envelope of the sound produced at the start of the note), a wind frequency parameter, a wind amplitude parameter, a harmonic level parameter, a fine frequency modulation parameter, and a chime release parameter. Each of the storage areas for the four sound processor chips, has a similar set of storage areas for each of the n stops, and each note of each of the stops has a storage area for the several parameters illustrated in expanded form for the note C1 of FIG. 3.

The program flow for the microprocessor for each of the sound generator boards is illustrated in FIG. 5A. When the organ is first turned on and has power applied, unit 120 initializes the operating parameters of the sound generator board micrprocessor to initial conditions. Then unit 122 receives control, which updates the parameters of each note and stop according to the data from the current finishing storage location, via the communication buffer. It does this by receiving the appropriate information from the master processor 17, by an interrupt processing routine. Then unit 124 receives control to determine whether there is any new note or stop data present in the communication buffer. If so, a new sound channel is assigned by unit 126, and control passes to unit 128. Otherwise, control passes directly to unit 128. A new sound channel is assigned by storing the parameters illustrated in the expanded portion for one of the 192 sound channels of FIG. 3 in the appropriate storage locations. A flag is set in the flag section to identify whether the sound channel is activated.

Unit 128 determines whether any sound channel is activated, and if not, passes control to unit 132. Otherwise, the data stored in the sound channel storage locations are sent to the appropriate sound processor chips, so that the appropriate notes are sounded with the appropriate characteristics. Then unit 132 receives control and controls the tremolo modulation of the output signal. Then unit 134 receives control and waits for 10 ms, after which control goes back to unit 124. In this way, each 10 ms, all the sound channels are updated in accordance with information received from the master microprocessor through the communication buffer, and the sound channels are updated and the appropriate information is send in each sound channel to the sound processor chips. This causes the sound processor chips to generate the sounds with the specified parameters.

When any interrupt is received from the master microprocessor, as new data is entered into its communications buffer, the normal loop is interrupted and unit 136 receives control (FIG. 5E). Unit 136 determines whether initialization is required, and if so, control passes to unit 144, which reads data from the master microprocessor and stores it in the communication buffer, after which the new data in the communication buffer is used in the course of the normal program flow for updating the sound channels and the sound processor chips.

If unit 136 determines that it is not an initialization phase, control passes to unit 137, which inspects whether the temperature has changed. If so, control passes directly to unit 142, for updating of the frequency parameter, as described in detail hereinafter. Otherwise, control passes to unit 138, which determines whether an interactive programming parameter has been specified. If not, control passes to the unit 144, and the new data is processed as described above. If an interactive programming parameter is specified, control passes to unit 140, which determines if it is a tremolo parameter. If so, control passes to unit 143, which updates the tremolo speed and depth parameters. Otherwise control passes to unit 142, which processes the other interactive programming parameters, and then control returns to the main routine.

Following any of the units 142–144, control returns to the main routine incorporating units 124–134, at the place where the interrupt occurred.

Referring to FIG. 5B, the content of unit 126 is shown in more detail, by which new sound channels are assigned. When the routine of FIG. 5B receives control, unit 250 determines whether a stop has been activated. If not, control immediately exits via line 254, which passes control to unit 128 (FIG. 5A). Otherwise, unit 252 receives control, which determines whether a note (octave) is on or off. If it is off, control passes to unit 256 which initiates a search for an active sound channel having the same code. Then unit 257 determines whether such a channel is found. If not, control passes to the exit via line 254. Otherwise, unit 262 receives control, which sets the phase flag to indicate a release phase, then control is returned via line 254.

If unit 252 determines that the note (octave) is on, unit 258 receives control which identifies the first available free channel, and unit 262 determines whether a free channel has been selected. If not, control returns via line 254. Otherwise, unit 264 receives control, which updates the parameters of the first available free channel selected in by means of unit 258. This updating includes a computation of the octave/note, sets the phase flag to indicate the attack phase, the nominal frequency, the fine frequency, the fluctuation tab pointer, the channel level, and the time counter is set to zero.

Figure 5C:
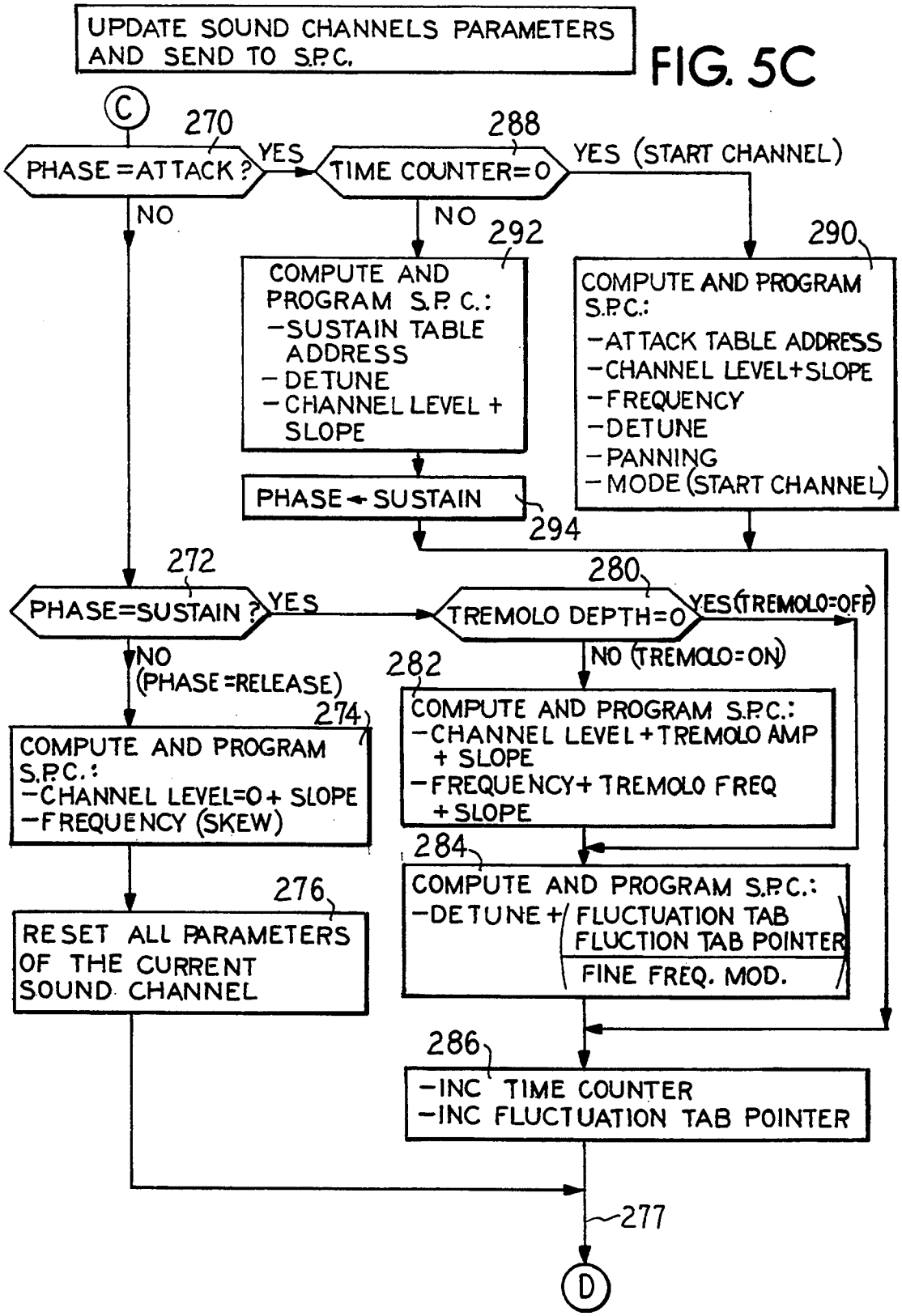

Details of the unit 130 (FIG. 5A) are illustrated in FIG. 5C. When this routine receives control, unit 270 determines whether the current phase is the attack phase. If not, control passes to unit 272, which determines whether the phase is the sustain phase. If not, the phase is recognized as being the release phase, and control is passed to unit 274 which computes the data necessary to program the SPC, including the channel level equal to 0 and the time rate of change of the level (slope), and the frequency adjustment for skew. When the channel level reaches 0, the unit 276 receives control, which resets the parameters of the current sound channel, to make it available for new notes.

If unit 272 recognizes a sustain phase, control passes to unit 280, which determines whether the tremolo has been turned on. If so, control passes to unit 282, which computes the data necessary to program the SPC for tremolo. This includes adjusting the channel level by adding the tremolo amplification factor, and the rate of change of the amplification, or slope. It also includes adjusting the frequency, by adding the tremolo frequency, and the slope. It also includes calculation of a detune parameter, by which the frequency of the note is detuned slightly from nominal, to account for fluctuation, and the like. Then control passes to unit 284. If unit 280 determines that the tremolo is not on, control passes immediately to unit 284. This unit computes data necessary to program the SPC in the sustain mode, which includes adjustment of a detune parameter by data modified by data from the fluctuation table taken from the location identified by the fluctuation table pointer, and the fine frequency modulation parameter. Then unit 286 receives control, which increments the time counter, and increments the fluctuation table pointer, so that the next entry in the fluctuation table will be used during the next time that the detuned function is executed. Then control exits over line 277 to unit 132 (FIG. 5A).

If unit 270 determines that the current phase is the attack phase, then control passes to unit 288, which determines whether the time counter is equal to zero. If so, the condition identified as the beginning of the attack phase is recognized, and control is passed to unit 290 which computes the data necessary for the SPC to execute the attack phase. This includes the attack table address, the channel amplitude or level and slope (the rate of change of amplitude), the frequency, the detune parameter, the panning parameter, and sets the mode to the start channel mode. Then control passes to unit 286 described above.

If the unit 288 determines that the time counter is not equal to zero, then unit 292 receives control, which computes data necessary to program the SPC for the attack phase. This includes the sustain table address, the detune parameter, and the channel level and slope. Then unit 294 receives control which sets the phase flag equal to sustain, and then passes control to unit 286. Accordingly, the next time the routine is entered, control passes to unit 272 and 280 to control the sustain operation.

Figure 5D:
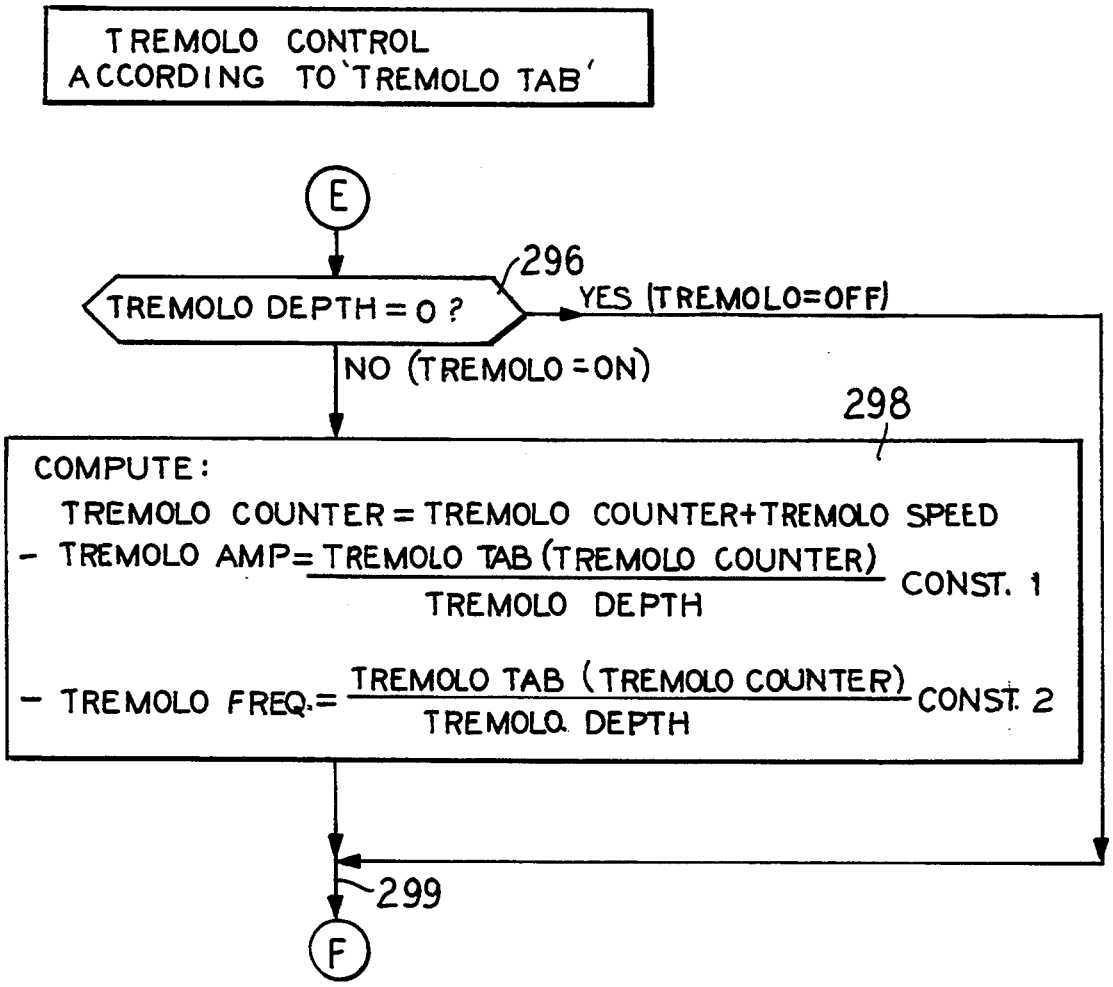

FIG. 5D illustrates details of the unit 132 (FIG. 5A), by which the tremolo is controlled according to the tremolo tab. Unit 296 first receives control and determines whether the tremolo is on or off. If off, control passes to exit over line 299 directly, which passes control to unit 134 (FIG. 5A). Otherwise, control passes to unit 298, which computes data necessary to execute the tremolo function. This includes updating the tremolo counter by adding a parameter corresponding to tremolo speed; updating the tremolo amplification factor and updating the tremolo frequency. The former is accomplished by obtaining a value from the tremolo table, using the tremolo counter as an index, dividing that value by the depth parameter, and multiplying it by a constant. Tremolo frequency is determined by the value from the tremolo table, divided by the depth parameter, multiplied by another constant.

Figure 7A:
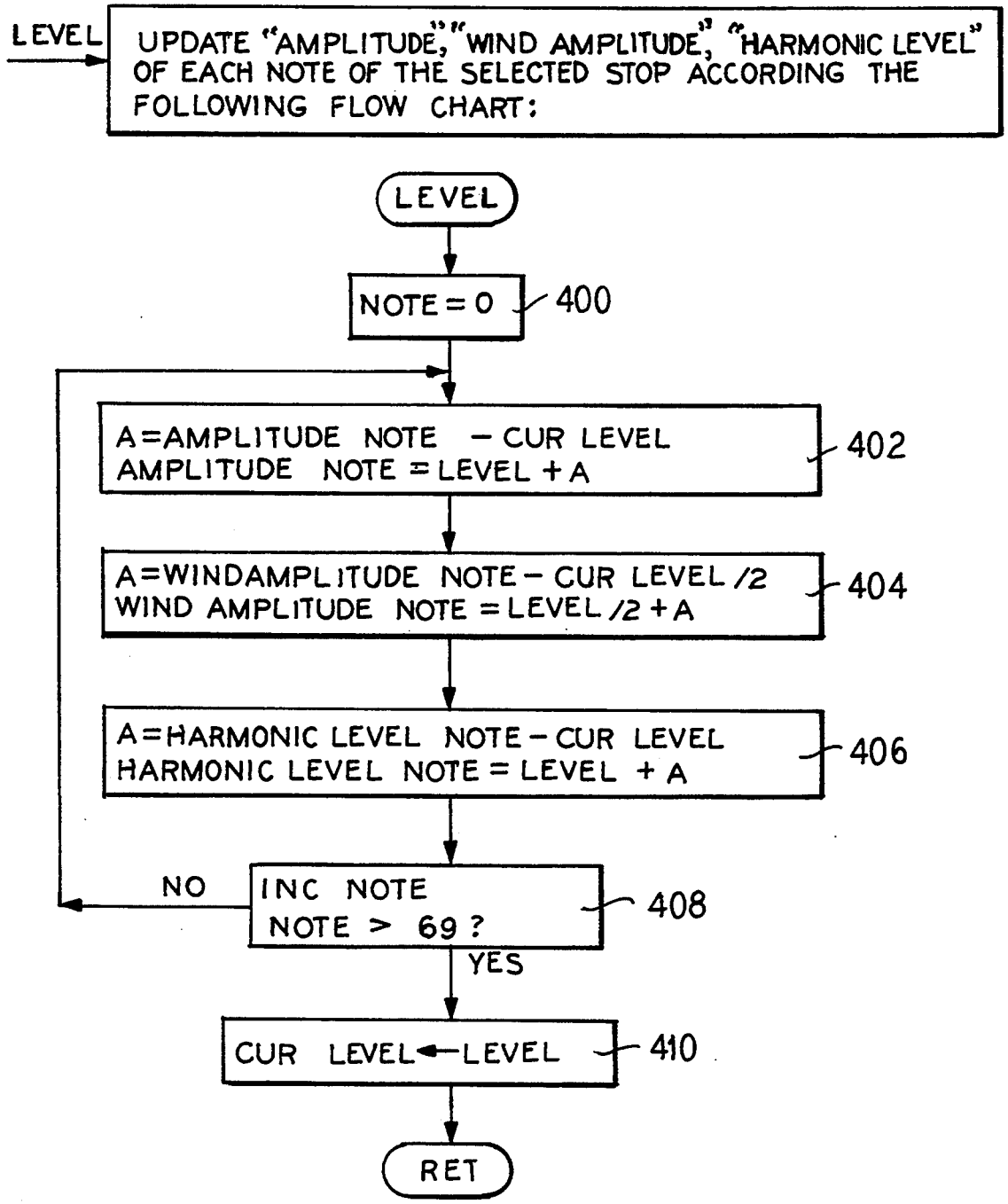
FIGS. 7A–7P are flowcharts of the parameter processing illustrated in FIG. 5.
Figure 7F:
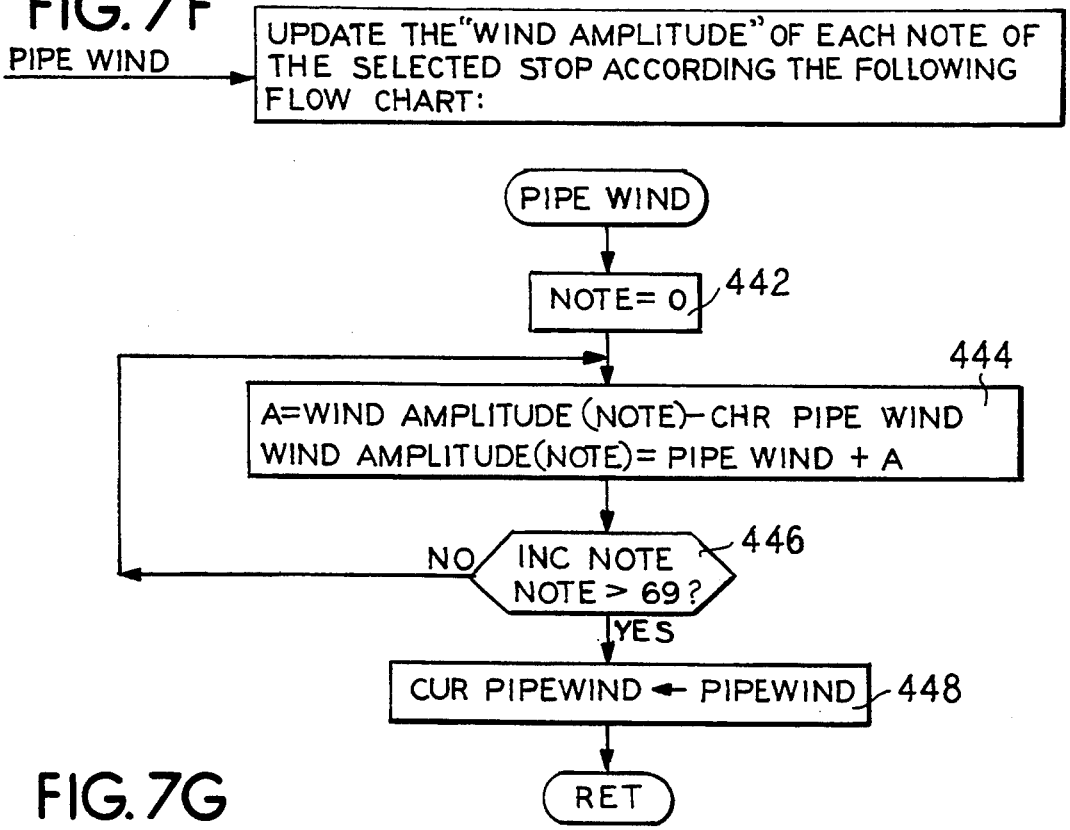
Figure 7G:
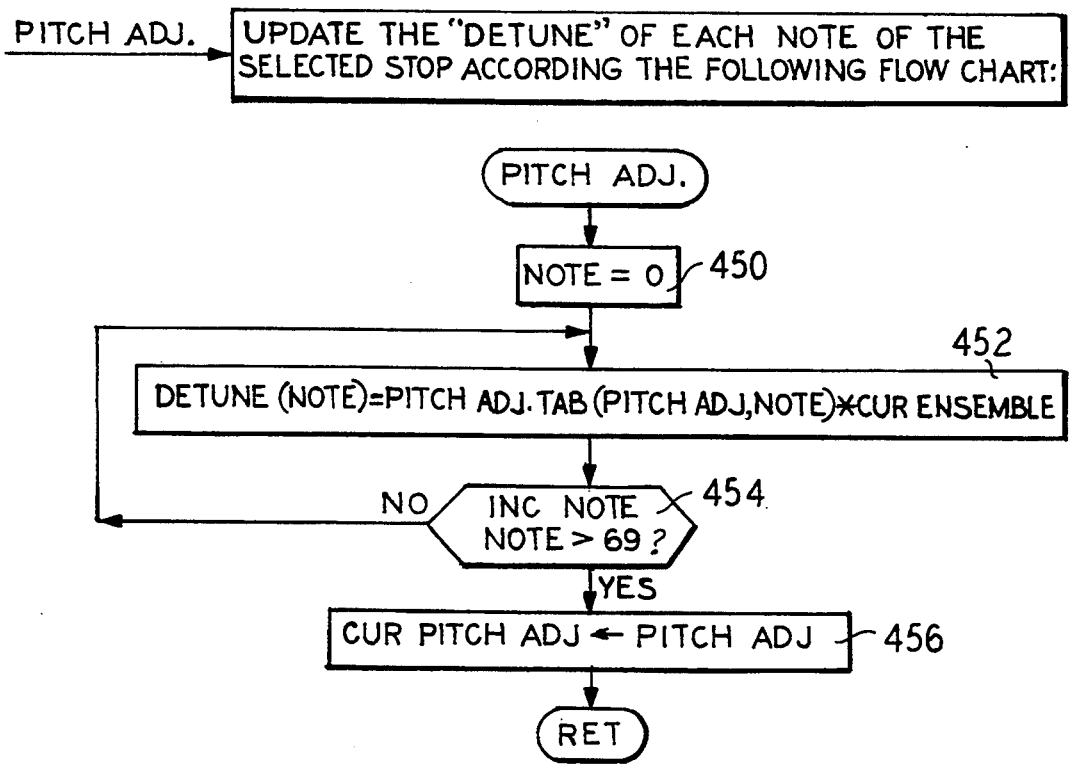
Figure 7H:
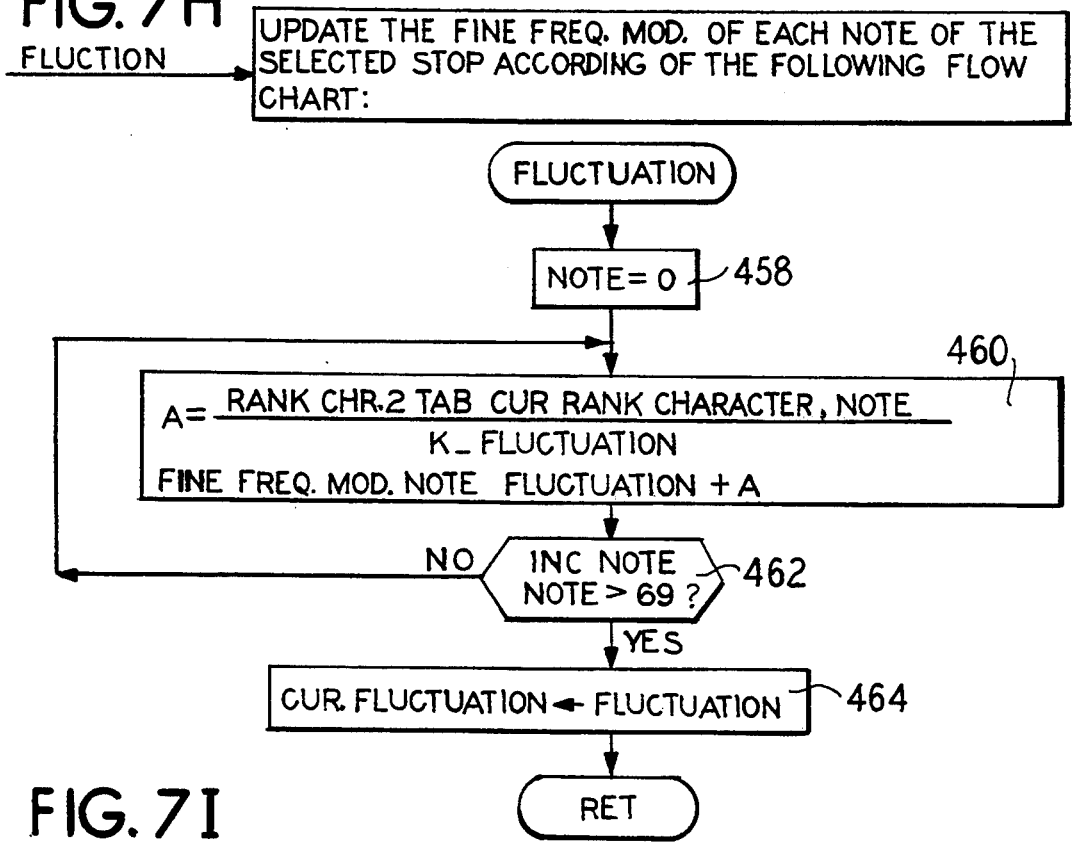
Figure 7I:
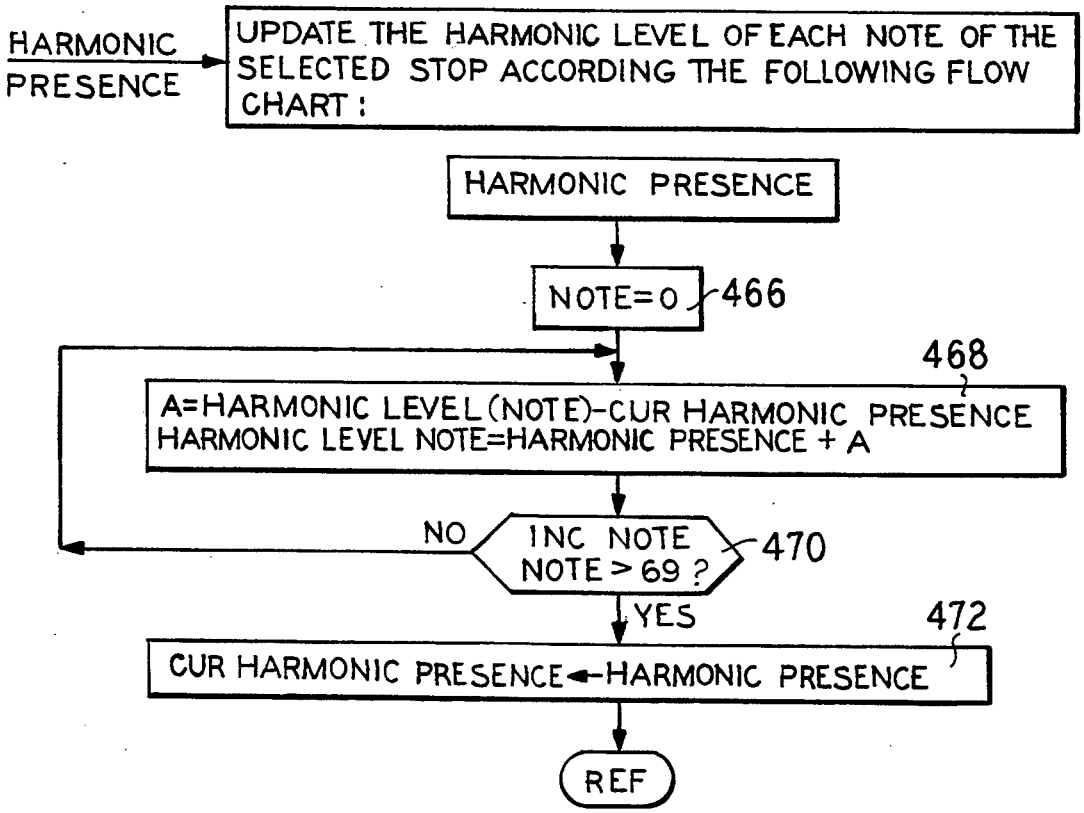
Figure 7J:
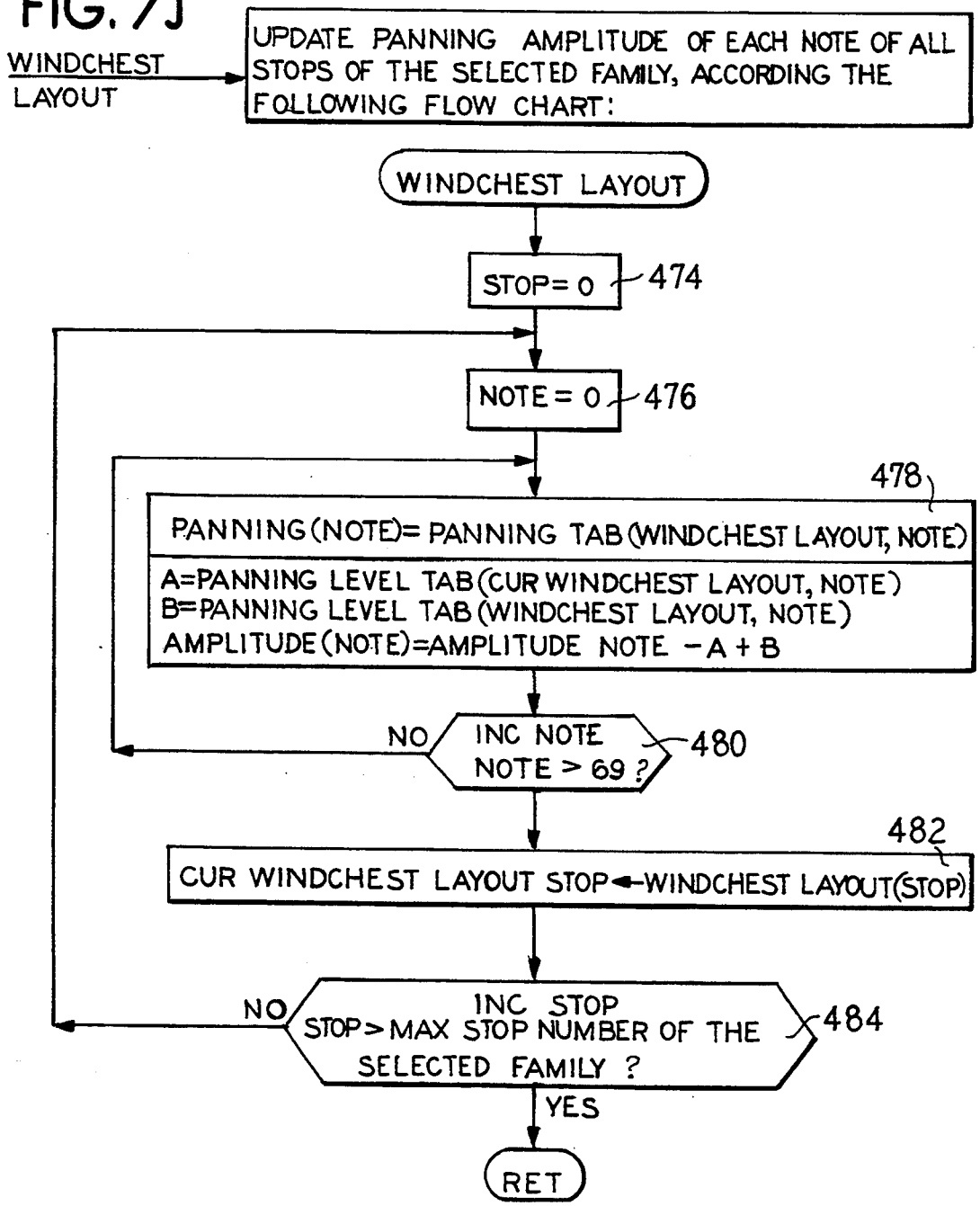
Figure 7K:
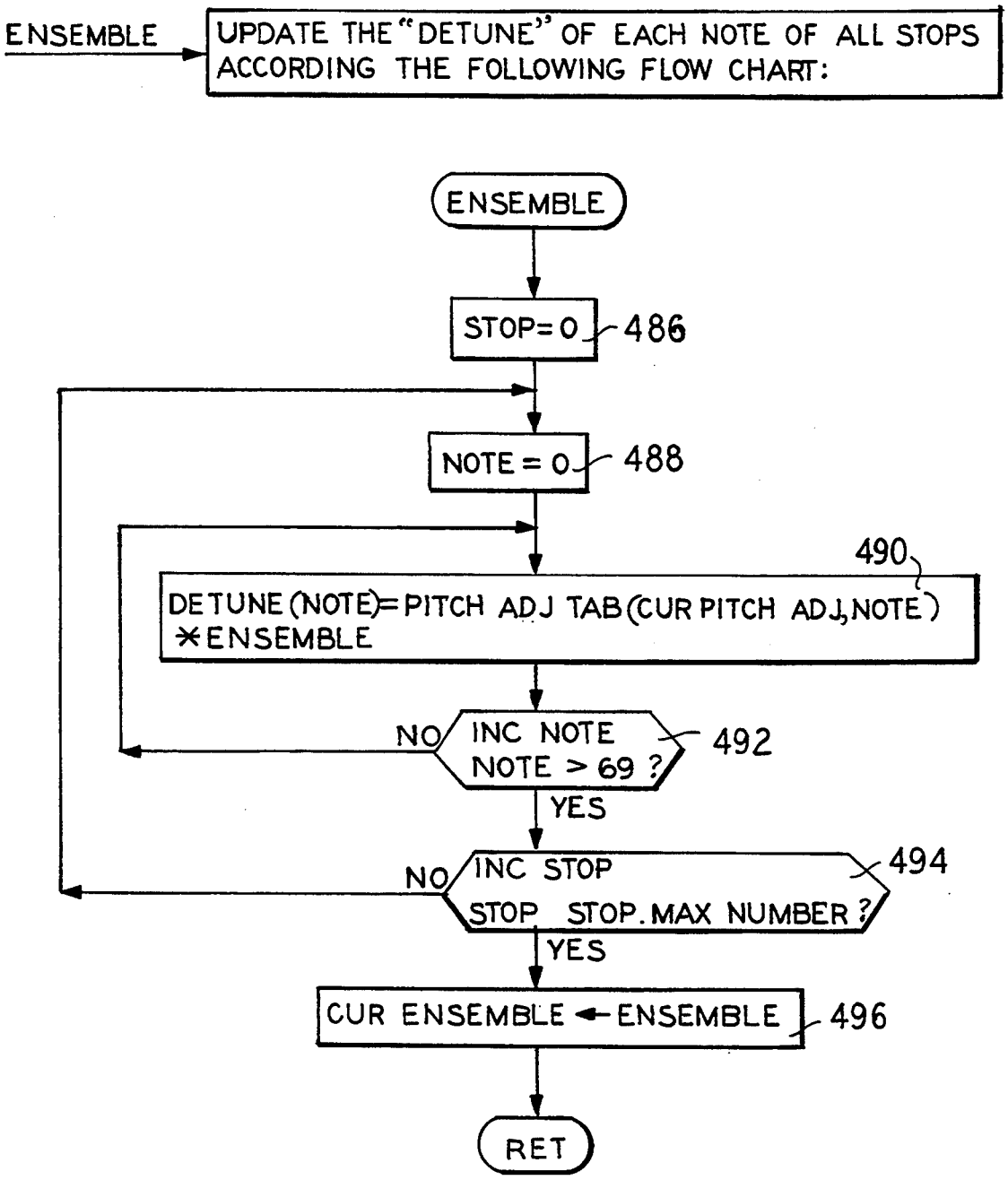
Figure 7L:
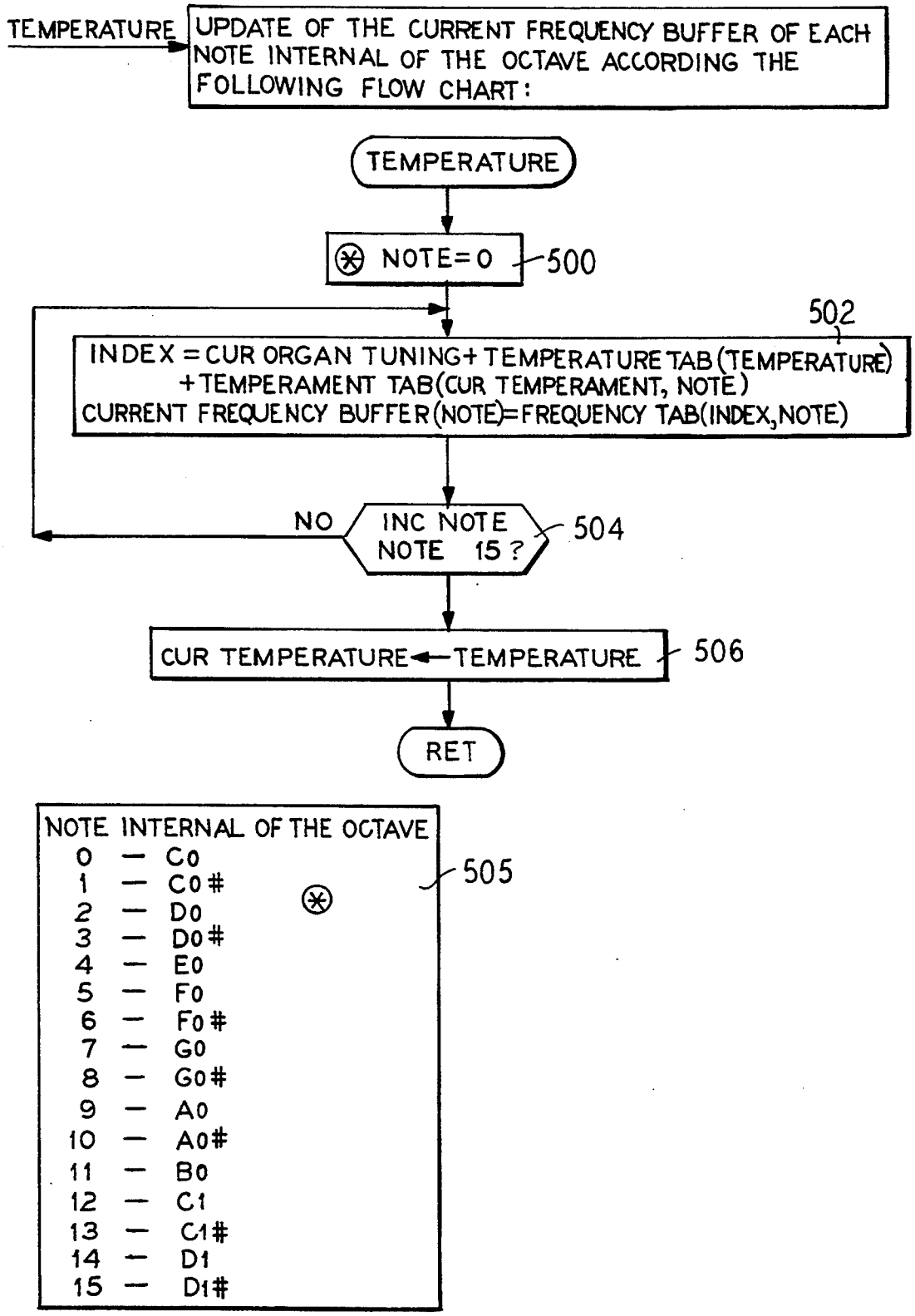
Figure 7M:
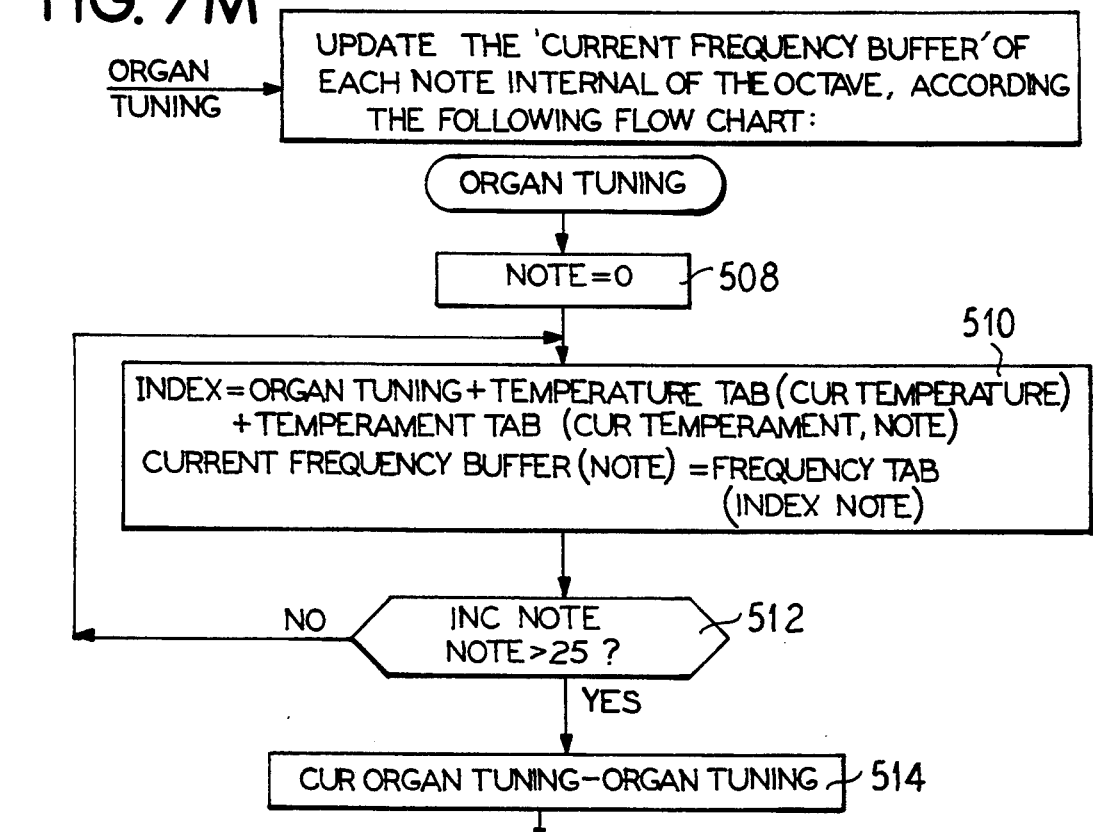
Figure 7N:
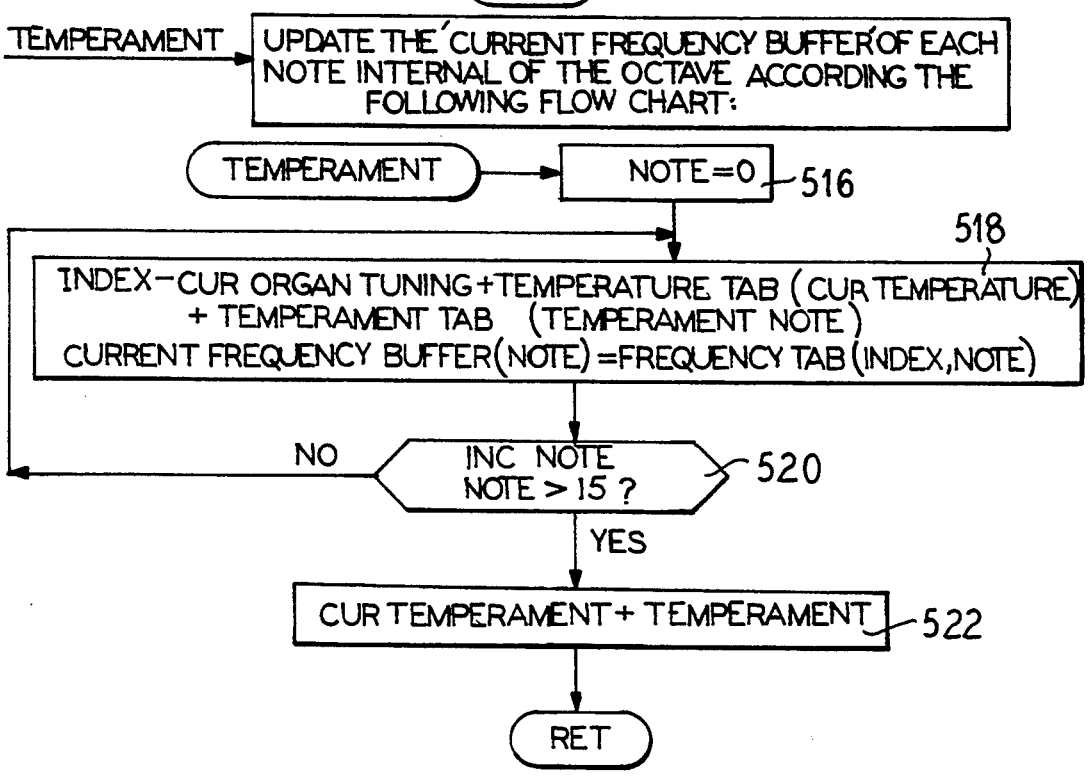
Figure 7P:
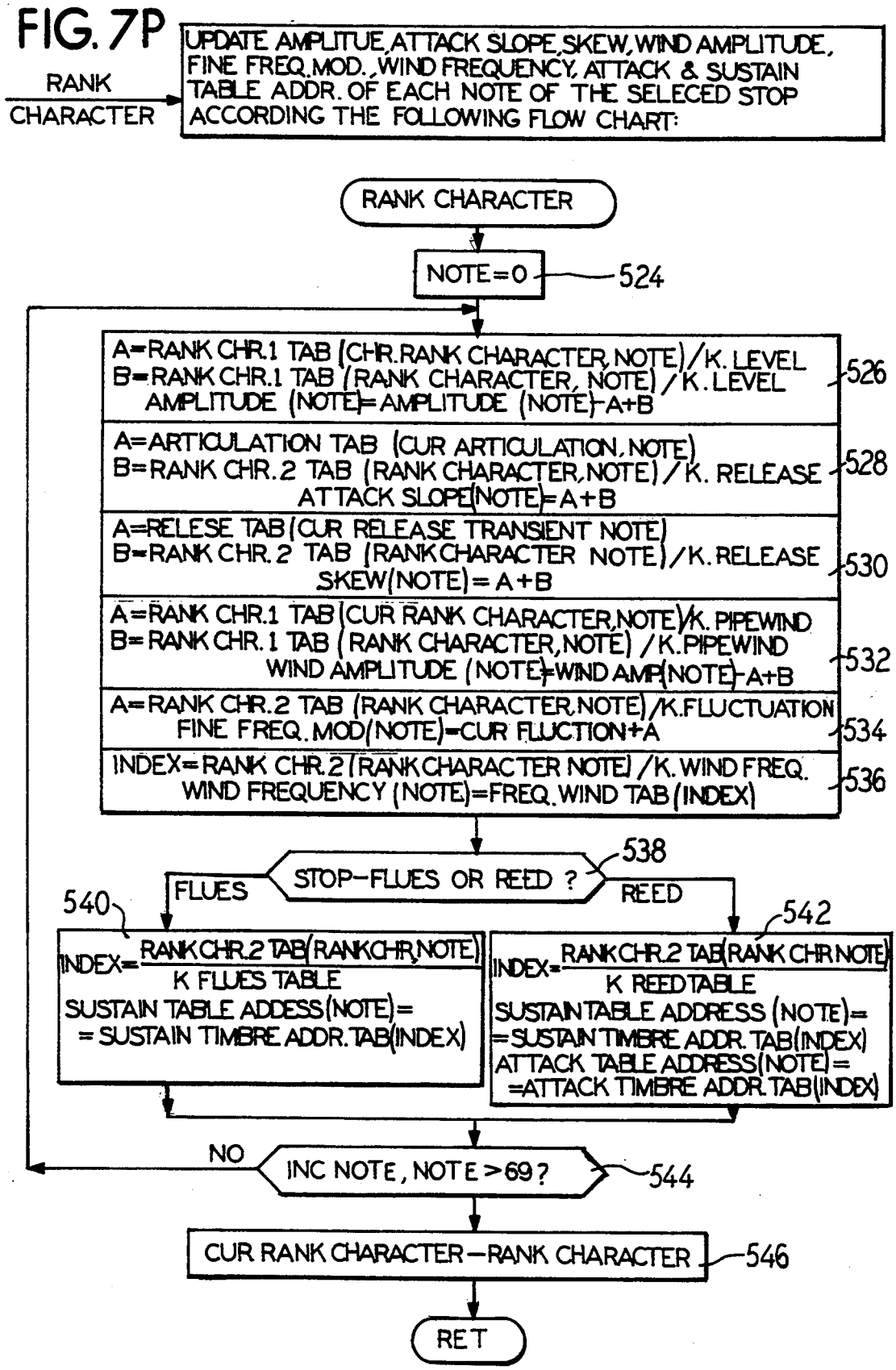

FIGS. 7A–7P illustrate, in flowchart form, routines which are performed in response to detection of various controls on the interactive programmer. The routine shown in FIG. 7A is entered when the level control is detected. Unit 400 first receives control and sets a note index equal to zero. Then unit 402 calculates an intermediate constant A, equal to the current amplitude for the current note (note 0) minus the current level parameter. Both of these parameters are stored in RAM as described above. Then a new amplitude parameter for the selected note (note 0) is calculated by adding the level parameter from the master microprocessor, plus the intermediate parameter A. Then unit 404 receives control and calculates an intermediate parameter A equal to the wind amplitude for a selected note, minus the current level divided by two. Then the wind amplitude is updated to equal the sum of the intermediate parameter A plus the new level divided by two. Then unit 406 receives control and calculates an intermediate parameter A corresponding to the harmonic level for the selected note minus the current level. Then the harmonic level is updated for that note by adding the intermediate parameter A to the level. Then unit 408 increments the note index and determines whether the note index is greater than 69. If not control returns to unit 402 so the above sequence is repeated for the next note, and for all other notes up to note number 69. Then unit 410 receives control and sets the current level equal to the level, and returns.

When the scaling control is recognized, unit 412 receives control and sets the note to zero and passes control to unit 414. Unit 414 retrieves the value from the scaling table, using as indices the current value and the note number. Then a second intermediate parameter B is extracted from the table using the scaling parameter from the master microprocessor, and the note number. Then a new amplitude for the that note is calculated by subtracting A and adding B from the current amplitude parameter for that note. The wind amplitude for the note is adjusted by subtracting A divided by 2 and adding B divided by 2, and the harmonic level for the note is adjusting by subtracting A and adding B. Then unit 416 receives control, which increments the note index and determines whether all of the notes have been processed. Otherwise, control returns to unit 414. After all the notes have been processed, so that new values are stored for amplitude, wind amplitude and harmonic level, unit 418 receives control and stores the scaling parameter as the current scaling factor. Then control returns to the main program.

FIG. 7C shows the routine which is executed when the chime delay control is recognized. Unit 420 receives control which sets the note index equal to 22. Then unit 422 receives control which determines a new value for the chime release for note number 22, according to the decay time table value, using as indices the chime decay parameter, and the note index. Then control passes to unit 424. When all of the notes up through note number 54 have been processed, control returns to the main program. Only notes 22 through 54 are affected.

The routine shown in FIG. 7D is entered when the articulation control is recognized. Unit 426 sets the note index equal to zero, and then unit 428 calculates two intermediate parameters. The A parameter is taken from the articulation table, using as indices the current articulation parameter and the note index, and the intermediate parameter B is extracted from the rank character-2 table, using as indices the current rank character and the note index, and this value is divided by the articulation constant. The attack slope for the given note is then calculated as A+ B and stored as a current attack slope parameter. Control then passes to unit 430 which increments the note index and determines whether all the notes have been processed. When they have, unit 432 receives control and sets the current articulation parameter equal to the articulation parameter specified by the interactive programmer.

FIG. 7E illustrates a routine which is entered when the release transient is to be modified. Unit 434 receives control which sets the note index to zero. Then unit 436 calculates two intermediate parameters. A is extracted from the release table using as indices the release transient parameter, and the note index. Intermediate parameter B is the quotient of the value taken from the rank character-2 table, using as indices the current rank character and the note index, divided by the release constant. The release transient or skew for the given note is set equal to A + B. Unit 438 increments the note index and determines whether all of the notes have been processed. When they have, the current release transient is updated by unit 440.

The routine in FIG. 7F receives control when the pipe wind is to be modified by a parameter from the interactive programmer. Unit 442 first sets the note index to zero, and unit 444 then modifies the wind amplitude for the selected note by adding the pipe wind parameter received from the master microprocessor to the stored parameter for the wind amplitude for that note, minus the current pipe wind parameter. Then unit 446 increments the note index and determines whether all of the notes have been processed. When they have, the current pipe wind parameter is updated by unit 448.

The routine of FIG. 7G is entered when a pitch adjustment is to be made. Unit 450 receives control and sets the note index equal to zero. Then unit 452 calculates a detune parameter for that note by extracting the value from the pitch adjustment table, using as indices the pitch adjustment received from the master microprocessor, and the note index, and multiplies its value by the current ensemble parameter. Then unit 454 receives control which increments the note index and determines whether all of the notes have been processed. When they have, unit 456 updates the stored value of the current pitch adjustment.

FIG. 7H receives control when the fluctuation is to be modified. Unit 458 first sets the note index equal to zero, and then unit 460 updates the fine frequency modification for that note. This is calculated by adding to the fluctuation parameter received from the master microprocessor an intermediate constant A, which is calculated by dividing a value extracted from the rank character-2 table using as indices the current rank character and the note index, by the fluctuation constant. Then unit 462 determines whether all the notes have been processed, and when they have, the current fluctuation is updated by unit 464.

The routine of FIG. 7I receives control when the harmonic presence is to be modified. Unit 466 first sets the note index equal to zero, then the unit 468 updates the stored value of the harmonic level for that note. This is calculated by adding to the harmonic presence parameters received from the master microprocessor an intermediate constant A equal to the current harmonic level parameter for that note minus the current harmonic presence parameter. Then unit 470 determines whether all notes have been processed, and when they have, unit 472 updates the current harmonic presence parameter.

The routine shown in FIG. 7J is entered when the windchest layout is to be modified. Units 474 and 476 first set the stop index and the note index equal to zero, and then unit 478 determines a panning parameter for the selected note of the selected stop (note number 0, stop number 0) by extracting a value from the panning table, using as indices the windchest layout parameter received from the master microprocessor, and the note index. Then two intermediate constants are extracted from the panning level table, using as indices the current windchest layout and the note index, on the one hand, and the stored value of the windchest layout and the note index on the other hand. Then a new value for the amplitude is calculated by subtracting A and adding B. Unit 480 receives control, which determines whether all of the notes of that have been processed. When they have, unit 482 receives control and updates the current value of the windchest layout for that stop. Then unit 484 increments the stop index number and determines whether all of the stops of the selected family have been processed. If not, control returns to unit 476 and the above process is repeated for all of the stops.

The routine shown in FIG. 7K receives control when the ensemble is to be updated. Units 486 and 488 set the indices for the stop and note to zero, and then unit 490 calculates a new detune parameter for the selected note of the selected stop, by extracting the value from the pitch adjustment table, using as indices the current pitch adjustment and the note index, and multiplies that by the ensemble parameter received from the master microprocessor. The unit 492 insures that all the notes of the selected stop are processed, and unit 494 insures that all of the stops are processed. Then unit 496 updates the stored value for the current ensemble value.

The routine shown in FIG. 7L receives control when the temperature needs to be modified. Unit 500 sets the note index equal to zero, then unit 502 calculates an intermediate parameter "index" equal to the current organ tuning parameter, plus a value from the temperature table, using the new temperature as an index, plus a value from the temperament table using as indices the current temperament and the note index. Then the frequency table is consulted, using as indices the "index" and the note index, the new value for the current frequency buffer parameter is extracted for the given note. Then unit 504 determines whether all fifteen of the notes which are internal of the octave have been processed and if so, unit 506 updates the stored value of the current temperature. The fifteen notes are identified in chart 505 in FIG. 7L.

The routine of FIG. 7M is entered when the organ tuning is to be modified. Unit 508 sets the note index equal to zero, and unit 510 receives control which calculates an intermediate "index" using the newly received organ tuning parameter, a value from the temperature table using as the current temperature as an index, and a value from the temperament table using as indices the current temperament and the note index. Then the current frequency for the selected note is updated by replacing it with a value from the frequency table using the "index" and note index as indices. Unit 512 determines whether all of the fifteen notes of the internal of the octave have been processed, and if so, unit 514 updates the stored value for the current organ tuning parameter.

FIG. 7N illustrates a routine which is entered when the temperament is to be adjusted. Unit 516 first receives control and sets the note index equal to zero, and then unit 518 calculates an intermediate index from the current organ tuning parameter, a value from the temperature table using the current temperature as the index, and a value from the temperament table using the new temperament value and the note index as indices. Then the current frequency for that note is updated with a value from the frequency table, using as indices the note index and the intermediate calculated index. Then unit 520 determines whether all of the notes of the internal of the octave have been processed, and if so, unit 522 updates the stored value of the current temperament.

FIG. 7P illustrates a routine when the rank character is to be adjusted. Unit 524 first sets the note index equal to zero, then unit 526 updates the value for the amplitude parameter for the selected note, by subtracting intermediate constant A and adding intermediate constant B. Intermediate constant A is calculated by dividing the value from the rank character-1 table, using as indices the current rank character parameter and the note index, by the level constant, and the intermediate parameter B is calculated by dividing a parameter taken from the rank character-1 table, using as indices the rank character and the note index, by the level constant. Unit 528 then calculates a value for the attack slope for the given note from two intermediate constants. The intermediate constants are taken from the articulation table using as indices the current articulation parameter and the note index, and from the rank character-2 table, using as indices a rank character parameter and the note index, with the latter intermediate constant being dividing an articulation constant. Then unit 530 updates the value skew for the selected note by adding two intermediate constants. The intermediate constants are determined from the release table, using as indices the current release transient parameter, and the note index, and the second intermediate parameter is taken from the rank character-2 table, using as indices the rank character parameter and the note index, with the extracted value divided by the release constant. Unit 532 then updates the wind amplitude for the selected note by subtracting intermediate constant A and adding intermediate constant B. The intermediate constant A is extracted from the rank character-1 table using as indices the current rank character parameter and the note index, and that value is divided by the pipe wind constant. The intermediate parameter B is extracted from the rank character-1 table using as indices the new value of the rank character and the note index, and that is also divided by the pipe wind constant. Then unit 534 calculates the new fine frequency modification parameter for the selected note by adding to the stored value of the current fluctuation parameter, and intermediate constant A is calculated by dividing the rank character-2 table by a fluctuation constant. The table is indexed with the new rank character parameter and the note index. Then unit 536 determines a new value for the wind frequency for the given note by extracting the value from a frequency wind table. An index to this table is calculated by dividing the value extracted from the rank character-2 table by the wind frequency constant. Indices to this table are the new value of the rank character and the note index. Then unit 538 determines whether the stop for which a rank character is being adjusted relates to flues or reeds. If the former, then unit 540 receives control. An intermediate index is calculated by dividing the value from the rank character-2 table by a flue table constant. The index to the rank character-2 table is the new value for the rank character, and the note index. This intermediate index is then used to index the sustain timbre address table which defines a new value for the sustain table address for the selected note. Then unit 544 determines whether all of note 0–69 have been processed and if not, the next note is processed beginning with unit 526. When all the notes are processed, unit 546 updates the stored value for the current rank character.

If unit 538 determines that the stop being processed relates to reeds, then unit 542 receives control. An "index" value is calculated by indexing the rank character-2 table with the new value of the rank character and the note index, and dividing the extracted value by a reed table constant. Then the sustain table address is calculated in the same manner as in unit 540. Then the attack table address is calculated by using the "index" to index the attack timbre address table.

Figure 9:
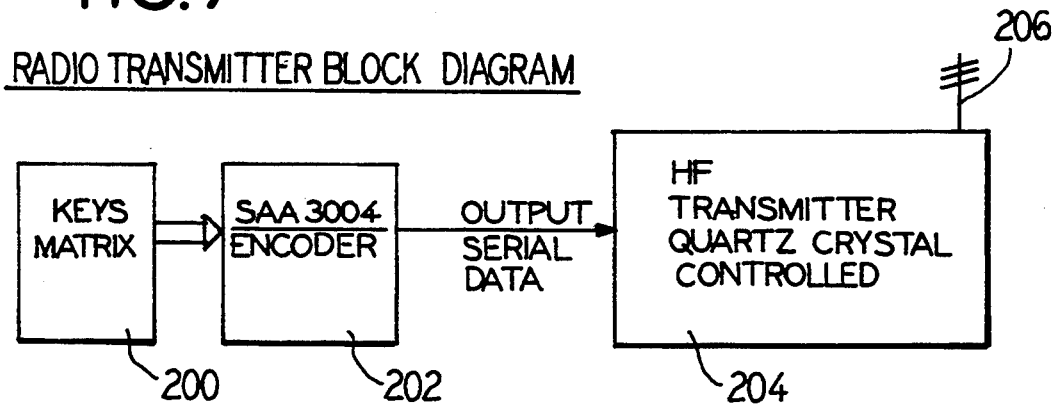
FIGS. 9 and 10 are functional block diagrams of the radio control for the interactive programmer.

FIG. 9 illustrates the transmitter used with the interactive programmer. The keyboard 200 (illustrated in greater detail in FIG. 8) is connected with an encoder 202, which produces output serial data corresponding to the keys which are depressed. The output of the encoder 202 is connected to a high frequency transmitter 204, which transmits serial data via an antenna 206.

Figure 10:
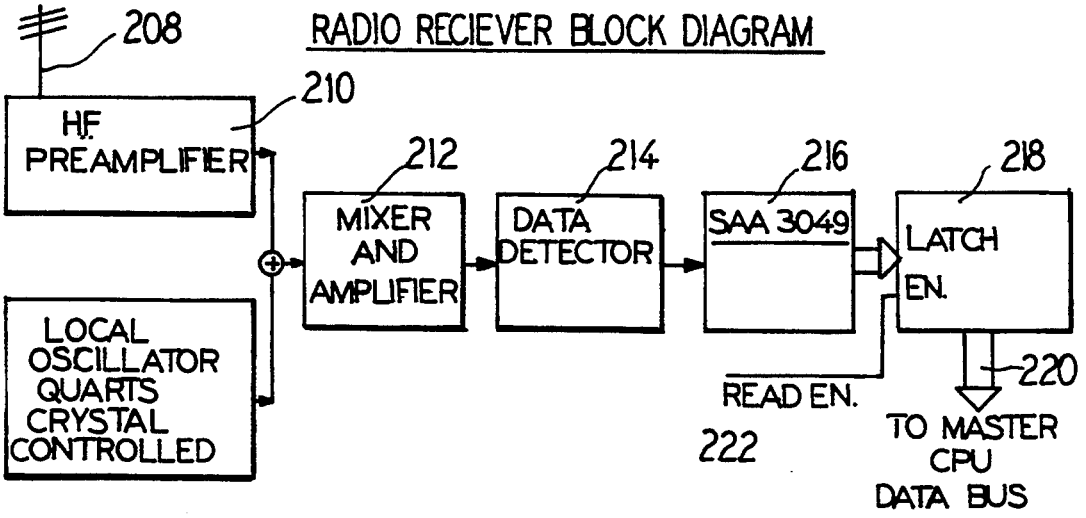

The receiver is illustrated in FIG. 10. An antenna 208 receives the signals transmitted by the transmitter 204, and a preamplifier 210 amplifies them and passes them to the input of a mixer 212, which also receives an input from the local oscillator 214. The mixer 212 demodulates and amplifies the transmitted data, and passes it to detector 214, which produces output serial data corresponding to the output of the encoder 202 (FIG. 9). The output of the detector 214 is connected to the input of the decoder 216, which decodes the serial data and places it in a latch 218. The content of the latch 218 may be read by the master microprocessor over a data bus 220, activating a line 222. The technology used within the components of the transmitter receiver shown in FIGS. 9 and 10 is conventional, and it may be any of the commonly available remote control technologies, which typically use infrared as the transmission vehicle between the transmitter and the receiver. The infrared mechanism is not suitable for transmission over great distances, however, which characterize the interior dimensions of churches and auditoriums and the like. It has proven far more satisfactory to use a RF transmitter, by which communication between transmitter and receiver is possible over far greater distances, exceeding 50 meters.

It is apparent that a great number of parameters are capable of being independently controlled for each note of each stop of an organ having any number of stops up to a total of n. These variations all go to make up the finishing of the organ, which is stored in the current finishing area or the RAM 19 (FIG. 2). As described above, the current finishing may be stored in any of the storage areas 1–4, for later recall, after which the current finishing may be changed to represent a different finishing for use with, for example, different music. At any time the previously established finishing may be recalled from one of the four storage areas into the current finishing location, instantly changing all of the characteristics described above for all of the notes of all of the stops. In this way, four complete finishings are always available to the operator virtually independently, simply by causing the data to be transferred from one of the four finishing storage areas to the current finishing area. The master microprocessor causes the several sound board microprocessors to update their data accordingly, and this data is used by the several sound generator board microprocessors to drive therefore sound processor chips, and the output of all of the sound processor chips is combined in the mixer 29 to be supplied to two or more loud speakers making up the output matrix 31.

Figure 11A:
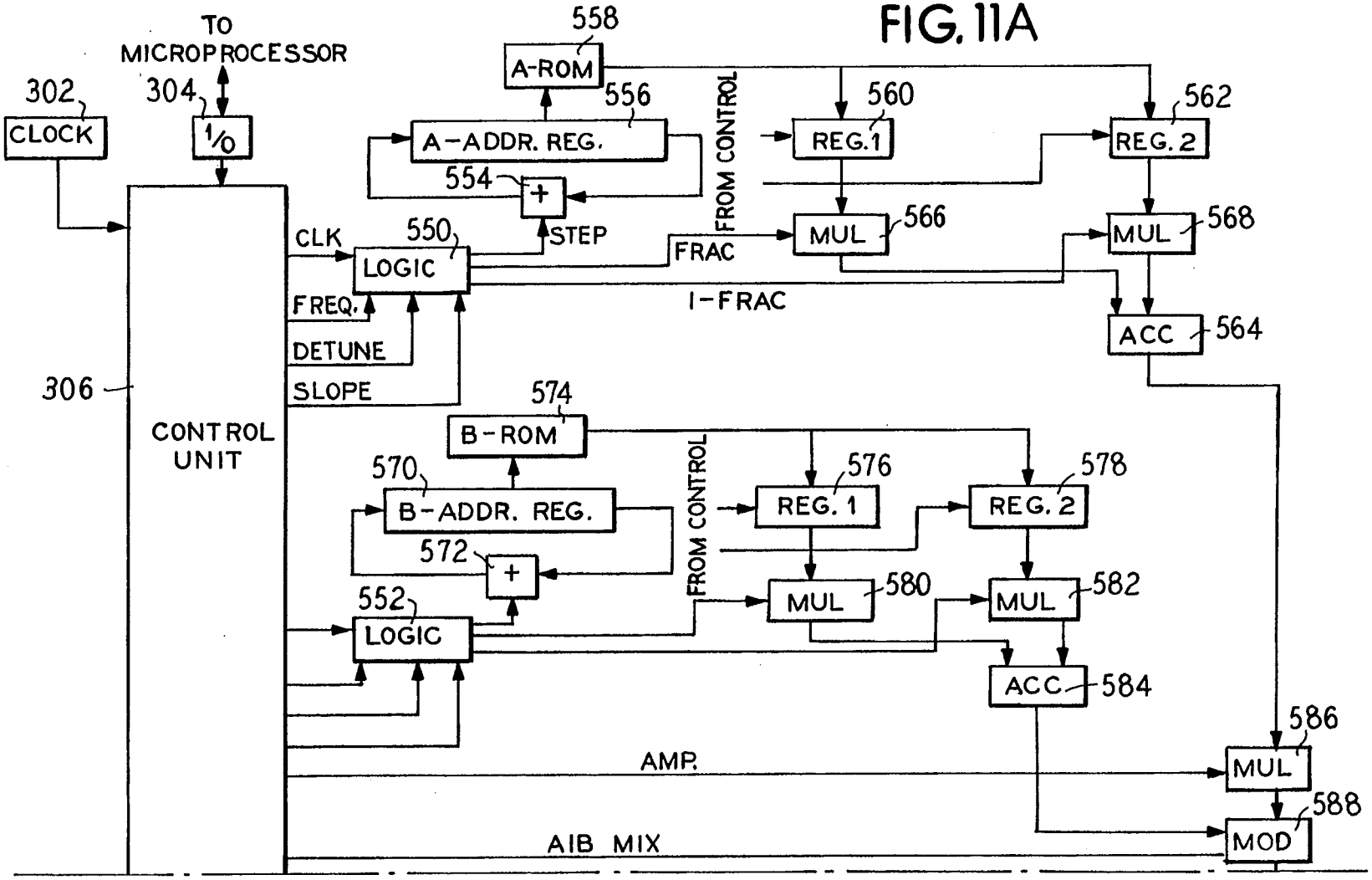
FIGS. 11A and 11B, taken together, comprise a functional block diagram of a sound processor chip.
Figure 11B:
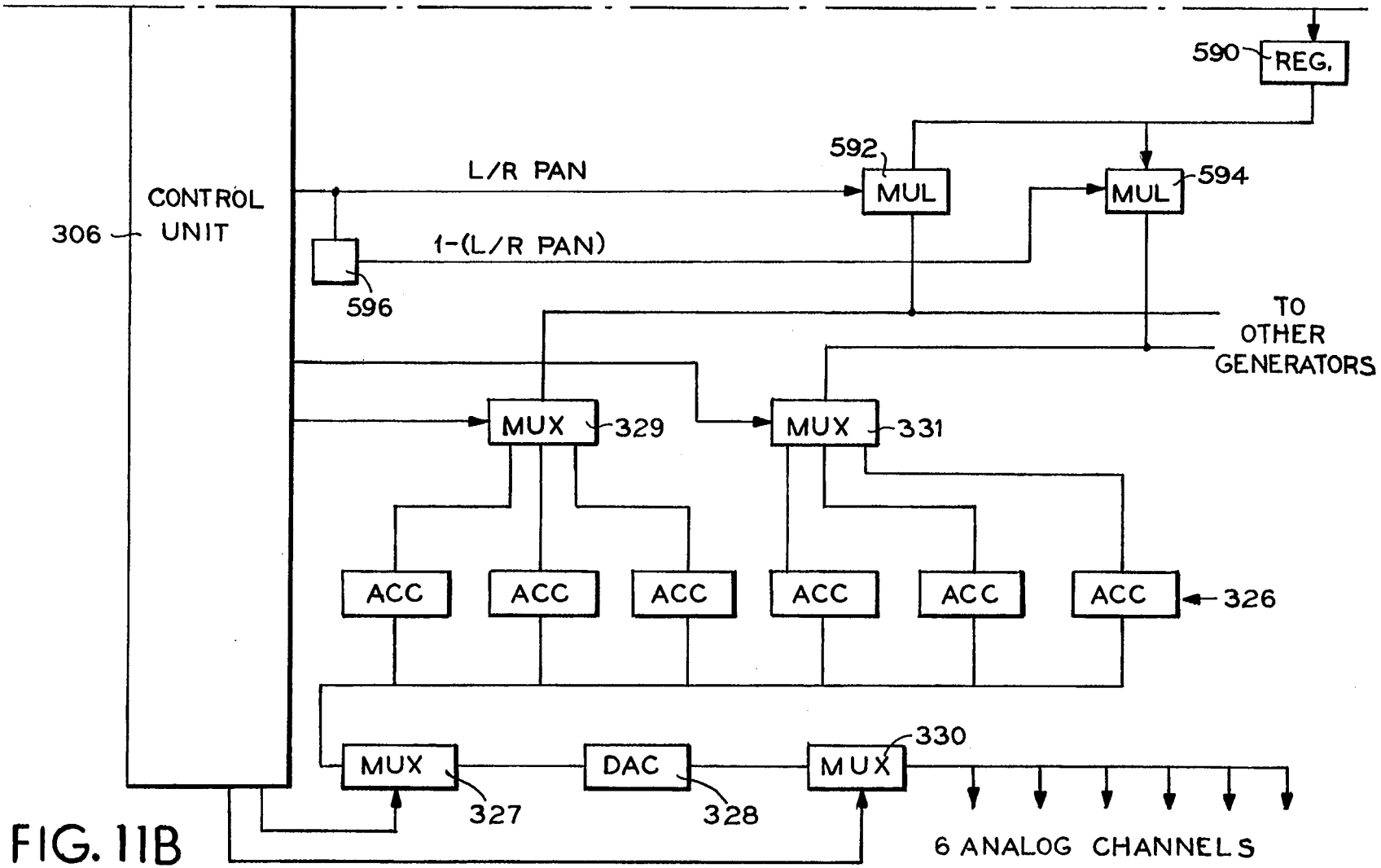

Now referring to FIG. 11, a functional block diagram of the SPC (sound processing chip) is illustrated. It incorporates a number of components, which cooperate together in the manner described hereinafter. A clock generator 302 is provided, so that a series of clock pulses with uniform pulse repetition rate is produced for timing the operations as necessary. A control 304 is provided for the input/output port, by which the SPC communicates with the microprocessor of the sound generator board. A control unit 306 is connected to the I/O unit 304 and to the clock generator 302, and produces control signals and timing signals necessary for operation of the other components of the SPC. The SPC has 24 generators, one of which is shown in FIG. 11.

Each of the 24 generators produces a digital output data periodically, corresponding to the relative amplitude of a component of the current organ sounds. These data are all accumulated in six accumulators 326, grouped as three left hand accumulators and three right hand accumulators. These are all connected via a multiplexer 327 to a digital-to-analog converter 328, the output of which is connected via multiplexer 330 to six output channels 332. Control of the multiplexing is regulated by the control unit 306, which selects one of the six accumulators 326 at a given time for connection to the DAC 328, and thence to one of the six outputs 332.

The generator illustrated in FIG. 11 has two subgenerators, each of which is provided with a logic unit 550 and 552, respectively. The logic unit 550 receives inputs from a control unit 306 corresponding to the frequency parameter, and the clock pulses produced by the clock generator 302. The logic unit 550 produces a step parameter which is periodically added to an A address register 556 by means of an adder 554. This addition occurs at regular periods determined by address clock pulses from the control unit 306. The address register 556 addresses a ROM unit 558 in which samples are stored of a sound component. Two successive samples are read from the ROM unit 558 into registers 560 and 562. These samples are interpolated by multiplying the contents of the registers 560 and 562 in multipliers 566 and 568, respectively, and accumulating the products in the accumulator 564. The multiplier 566 receives an input from the logic unit 550 corresponding to a fractional part of a step, the integral portion of the step being supplied to the A address register 556 via the adder 554. The fractional part of the step is a parameter between zero and one, and the quantity one less than this parameter is supplied to the other multiplier 568, so that the result in the accumulator 564 is proportional to an interpolated value between the values in the registers 560 and 562, in accordance with the size of the fractional portion of the step.

The frequency of the sound produced, represented by digital values read from the ROM 558 depends on the rate in which the sample value is stored in the ROM 558 are scanned. When a large step value is added to the address register 556, the sample values read from the ROM have a higher frequency. Small changes in frequency are accommodated by interpolation, using the fractional portion of the step. For example, if the desired frequencies requires that the step of 0.7 be used, the first time the ROM 558 is accessed, the data stored at position 0 and 1 are read into the registers 560 and 562, and the result in accumulator 564 is proportional to an interpolated value 70% from the first to the second value read from the ROM. The next access to the ROM 558 (corresponding to relative time 1.4) causes the data stored in the first and second storage locations of the ROM to be read to the registers 560 and 562 with 40% being used as a fractional part of the step. At the next access (corresponding to relative time 2.1), the second and third data locations are read and 10% is the fractional step factor.

A second subgenerator, using the logic unit 552, has a B address register 570, and an adder 572 by which steps are periodically added to the address register. The B ROM 574 is accessed, and data is supplied from registers 576 and 578 and interpolated by use of multipliers 580 and 582 in an accumulator 584.

The contents of the accumulator 564 is supplied as am input parameter to a multiplier 586, which receives as another input, the amplification parameter from the control unit 306. The output of the multiplier 586 is supplied to a modulator 588 which modulates the output of the multiplier 580 with the output of the accumulator 584, in accordance with the A/B mix parameter, which is a number between 0 and 1. Thus,the data from the A ROM 558 is modulated with data from the B ROM 584 in accordance with the magnitude of the parameter A/B mix. When this parameter is zero, the data from the A ROM 558 is not changed. When this parameter is one, the A data is modulated 100% with the B data. The result is held in a register 590, which furnishes inputs to two further multipliers 592 and 594. The multiplier 592 receives an input from the control unit 306 corresponding to the parameter L/R pan, which defines what proportion of sound is to be produced on the left hand side. This parameter is between zero and 1. The unit 596 calculates one minus the L/R parameter, and supplies it as the operand of the multiplier 594. The result is that the output of the multiplier 592 supplies signals corresponding to sounds to be produced on the left hand side, while the output of multiplier 594 produces signals corresponding to sounds to be produced on the right hand side. The output lines of these multipliers are connected in common to 23 other generators of the SPC, not shown in FIG. 11.

The lines connected in common from all of the left hand multipliers such as the multiplier 592 is connected to the input of the multiplexer 329. The multiplexer 329 has three outputs connected to three accumulators 326, so that any one or more of the accumulators may receive the output of any of the left hand multipliers such as the multiplier 592, under control of the control unit 306. A similar multiplexer 331 is provided for three accumulators for the accumulation of signals corresponding to right hand sounds.

All six of the accumulators 326 are connected via multiplexer 327 to the DAC 328 and thence through the multiplexer 330 to six analog output channels 332. The multiplexers 327 and 330 are controlled by means of the control unit 306.

All of the 24 generators of the SPC have apparatus corresponding to the units 550–596, which are controlled by means of the control unit 306, which is in turn under control of the microprocessor via the I/O unit 304. Since each of the four chips has 24 generators, a total of 192 generators is provided, and these generators correspond to the 192 channels discussed above in connection with FIG. 3. These generators are assigned to any note which may be operative at any given time, and plural generators are assigned to the same note, when complex sounds are required. The provision of two subgenerators for each generator, having the capacity for scanning independent ROM addresses at independent speeds, with control via the A/B mix (over the way the data is mixed) provides an extremely flexible mechanism for producing many complex sound components simultaneously.

The data stored in the ROM 558 and 574, another ROM select them, correspond to digitized samples of sounds recorded from actual classic organs. Some of the ROMS contain data corresponding to the sustain or release phase of the various notes produced on actual organs, and others correspond to the attack phase of the notes. The data required in all the other components of the sounds are also stored in separate ROM addresses, and may be accessed simultaneously with the attack, sustain and decay phases. For example, the pipe wind component is stored separately in the ROM memory, and may be accessed and combined with other sounds in the proportions desired.

It will be apparent that various modifications and additions may be made in the apparatus and methods of the present invention without departing from the essential features of novelty thereof, which are intended to be defined and secured by the appended claims.

What is claimed is:

1. Apparatus for producing classic organ sounds including a first operator controlled keyboard at a first location for selecting stops each having a group of notes, and for selecting notes to be sounded in real time, a second operator controlled programming key pad at a second location for defining parameters related to individual qualities of all of the notes of said selected stops, and means for sounding said notes as they are selected at the location of said first operator controlled keyboard, characterized in that there is provided storage means for storing representations of a multiplicity of said parameters for each of said notes, said representations of parameters being individually modifiable by means of said second keyboard in order to adjust tonal qualities of said classic organ sounds, and said means for sounding is controlled by said stored representations of parameters.

2. Apparatus according to claim 1, including operator controlled stop means, by which sound qualities common to a plurality of stops, each stop comprising a plurality of said notes, may be defined, and characterized by storage means under the control of said second operator controlled programming keyboard for storing parameters related to a multiplicity of individual sound qualities of said stops, and said means for sounding is controlled by said stored parameters, for affecting the sound qualities of all of said stops.

3. Apparatus according to claim 1, characterized in that said means for sounding comprises means for storing digital representations of a plurality of sound segments, a digital to analog converter for converting a plurality of said digital representations of sound segments into analog form in response to said stored parameters.

4. Apparatus according to claim 1, characterized in that said storage means incorporates means for storing, individually for each note of each stop, a panning parameter defining the apparent location of said note when it is sounded, means for adjusting said panning parameters in response to operation of said second key pad, and said sounding means having a plurality of spatially separated sound reproducing means, and means for controlling the operation of each of said sound reproducing means in response to said panning parameters.

5. Apparatus according to claim 1, characterized in that said stored parameters are grouped into a plurality of groups corresponding to plural finishings, each of said groups defining characteristics of said plurality of said notes, and means for individually selecting one of said groups to select a given combination of tonal qualities.

6. Apparatus according to claim 1, characterized in that a remote control transmitter and a remote control receiver is provided, said second keyboard being connected to said remote control transmitter, and said remote control receiver being connected to said storage means.

7. Apparatus according to claim 1, characterized in that a disk storage device is provided for permanently storing said parameters, and means for selectively storing, in said disk storage device, a complete set of said stored parameters controlling all of the sound qualities of all of said stops and all of their notes, and means for recalling from said disk storage device a complete set of parameters and storing the same in said storage means, for controlling all of the sound qualities of all of said stops and all of their notes.

8. Apparatus according to claim 7, characterized in that said disk storage device stores said parameters independently from data representing a sequence of notes to be sounded.

9. Apparatus according to claim 1, characterized in that there is provided means operative in response to said second keyboard for producing a series of random numbers, and means for randomly modifying, said stored representations of parameters for a multiplicity of sound qualities, on a note by note basis, under control of said stored parameters.

10. Apparatus according to claim 9, characterized in that there is provided means for producing two separate series of random numbers, with some of said stored representations of parameters affected by one series and other said stored representations of parameters affected by the other series.

11. Apparatus according to claim 1, characterized in that said storage means includes means for storing, individually for each of a plurality of notes of each of said stops, a level parameter defining the level of amplitude of said note, and means for storing, individually for each of said notes of each of said stops a scaling parameter defining the values of the level parameters in relation to each other for said notes.

12. Apparatus according to claim 1, characterized in that said storage means includes means for storing, individually for each of the of each stop, a panning parameter defining the apparent position at which said note is sounded, and means under control of said second keyboard for defining said panning parameter for each of said notes in order to define a complete series of apparent positions for said notes in accordance with a selected wind chest layout.

13. Apparatus for producing classic organ sounds including a first operator controlled keyboard for selecting stops each having a plurality of notes and for selecting notes of said stops to be sounded in real time, a second operator controlled programming key pad at a different location for defining parameters related to individual qualities of said notes, and means for sounding said notes as they are selected, characterized in that there is a provided storage means for storing representations of a multiplicity of said parameters for each of said notes of each of said stops, said representations of parameters being individually modifiable by means of said second keyboard, and said means for sounding is controlled by said stored parameters, and said stored parameters are grouped into a plurality of groups each defining a predetermined combination of tonal qualities, each of said groups defining characteristics of a plurality of said notes, and means for individually selecting one of said groups, and at least two of said groups define, individually for each of said notes, all of the qualities of all of said notes, whereby the sound qualities of all of said stops and their notes may be defined at any time by selecting one of said two groups, whereby all of the sound qualities of all of said notes may be defined simultaneously in accordance with the selected group to define the combination of tonal qualities of all of the sounds.

14. Apparatus according to claim 13, characterized by means for storing four of said groups, whereby any of four different finishings may be selected, and the sound qualities of all of said notes of said stops are defined simultaneously in accordance with the selected finishing.

15. Apparatus for producing classic organ sounds including a first operator controlled keyboard for selecting notes to be sounded in real time, a second operator controlled programming key pad at different location for defining parameters related to individual qualities of said notes, and means for sounding said notes as they are selected, characterized in that there is provided storage means for storing representations of a multiplicity of said parameters for each of said notes, said representations of parameters being individually modifiable by means of said second keyboard, and said means for sounding is controlled by said stored parameters, and said sound producing means includes means for storing plural digital data segments representative of sound segments for each of said notes, means for reading the data in said segments in timed sequence and for converting said data into analog signals, to reproduce sounds corresponding to said segments, and means under the control of said stored parameters for for determining the amplitude of said analog signals for each of said segments, individually.

16. Apparatus for producing classic organ sounds including a first operator controlled keyboard for selecting notes to be sounded in real time, a second operator controlled programming key pad at a different location for defining parameters related to individual qualities of said notes, and means for sounding said notes as they are selected, characterized in that there is provided storage means for storing representations of a multiplicity of said parameters for each of said notes, said representations of parameters being individually modifiable by means of said second keyboard, and said means for sounding is controlled by said stored parameters, and a plurality of digital data time segments are provided for at least some of said notes, and the selection of which said plurality of digital data segments is read is under the control of said stored parameters.

17. Apparatus according to claim 16, characterized in that a plurality of said digital data segments are read simultaneously for producing plural components of a composite sound, and the designation of the digital data segments which are read simultaneously is defined by said stored parameters.

18. Apparatus according to claim 16, characterized in that there is provided means for randomly selecting one of said digital data segments for reading at any given time, under control of said stored parameters.

19. Apparatus according to claim 17, characterized in that there is provided means for randomly selecting at least one of said simultaneously read digital data segments under control of said stored parameters.

20. Apparatus according to claim 16, characterized in that a plurality of digital data segments are provided for all of said notes, and including means under control of said stored parameters for randomly selecting one of said plurality of data segments for use in sounding each of said notes.

21. Apparatus for producing classic organ sounds including a first operator controlled keyboard for selecting notes to be sounded in real time, a second operator controlled programming keyboard for defining parameters related to individual qualities of said notes, and means for sounding said notes as they are selected, characterized in that there is provided storage means for storing representations of a multiplicity of said parameters for each of said notes, said representations of parameters being individually modifiable by means of said second keyboard, and said means for sounding is controlled by said stored parameters, and said stored parameters comprise parameters relating to the volume level of each note, the timbre of each note, the level of harmonic presence for each note, the level of pipe wind for each note, the articulation for the start of the sound for each note, the shift in frequency during the start of the sound for each note, the shift in frequency at the end of the sound for each note, the fluctuation in frequency during the sounding of each note, and a panning parameter for each note which collectively defines a wind chest layout.

* * * * *